US012642306B2

(12) United States Patent
Murphy

(10) Patent No.: US 12,642,306 B2
(45) Date of Patent: Jun. 2, 2026

(54) ACTIVATION OF VAPORIZER DEVICES

(71) Applicant: JUUL Labs, Inc., San Francisco, CA (US)

(72) Inventor: Andrew L. Murphy, San Francisco, CA (US)

(73) Assignee: JUUL Labs, Inc., Washington, DC (US)

( * ) Notice: Subject to any disclaimer, the term of this patent is extended or adjusted under 35 U.S.C. 154(b) by 577 days.

(21) Appl. No.: 17/887,213

(22) Filed: Aug. 12, 2022

(65) Prior Publication Data

US 2022/0378111 A1 Dec. 1, 2022

Related U.S. Application Data

(63) Continuation of application No. PCT/US2021/017769, filed on Feb. 12, 2021.
(Continued)

(51) Int. Cl.
*A24F 40/65* (2020.01)
*A24F 40/40* (2020.01)
*A24F 40/51* (2020.01)

(52) U.S. Cl.
CPC ..... *A24F 40/65* (2020.01); *A24F 40/40* (2020.01); *A24F 40/51* (2020.01)

(58) Field of Classification Search
None
See application file for complete search history.

(56) References Cited

U.S. PATENT DOCUMENTS 5,610,635 A 3/1997 Murray et al.
8,402,976 B2 3/2013 Fernando et al.
(Continued)

FOREIGN PATENT DOCUMENTS

CN 201067079 Y 6/2008
CN 203289647 U * 11/2013
(Continued)

OTHER PUBLICATIONS

Pham Manh Cuong. (Feb. 28, 2011) "A Clustering Approach for Collaborative Filtering Recommendation Using Social Network Analysis", Journal of Universal Computer Science, 17(4):583-604.
(Continued)

*Primary Examiner* — Jason Lin
(74) *Attorney, Agent, or Firm* — Mintz Levin Cohn Ferris Glovsky and Popeo, P.C.

(57) ABSTRACT

A method for activating a vaporizer device may include a point-of-sale device receiving, based on an identifier of the vaporizer device, activation data associated with the vaporizer device. The vaporizer device may be activated by communicating, to the vaporizer device, the activation data. The point-of-sale device may communicate the activation data to the vaporizer device via a dock coupled with the vaporizer device. Moreover, the point-of-sale device may communicate the activation data to the vaporizer device through a packaging of the vaporizer device. Alternatively, the point-of-sale device may communicates the activation data to the vaporizer device by communicating the activation data to a computing device associated with a user of the vaporizer device. The computing device may further communicate the activation data to the vaporizer device via audio signals and/or optical signals corresponding to the activation data. Related systems and articles of manufacture are also provided.

16 Claims, 31 Drawing Sheets

Related U.S. Application Data

(60) Provisional application No. 63/052,837, filed on Jul. 16, 2020, provisional application No. 62/976,932, filed on Feb. 14, 2020.

(56) References Cited

U.S. PATENT DOCUMENTS 8,550,069 B2 10/2013 Alelov
8,807,131 B1 8/2014 Tunnell et al.
9,439,455 B2 9/2016 Alarcon et al.
9,462,832 B2 10/2016 Lord
9,609,895 B2 4/2017 Galloway et al.
9,770,055 B2 9/2017 Cameron et al.
9,877,519 B2 1/2018 Xiang
10,058,124 B2 8/2018 Monsees et al.
10,131,532 B2 11/2018 Murison et al.
10,375,990 B2 8/2019 Lord
10,448,670 B2 10/2019 Talon et al.
10,945,463 B2 3/2021 Dickens et al.
2005/0066961 A1 3/2005 Rand
2009/0266358 A1 10/2009 Rock et al.
2010/0191385 A1 7/2010 Goodnow et al.
2010/0234987 A1 9/2010 Benschop et al.
2011/0036346 A1 2/2011 Cohen et al.
2011/0097060 A1 4/2011 Buzzetti
2011/0150294 A1 6/2011 Eckhoff et al.
2012/0227752 A1 9/2012 Alelov
2012/0255546 A1* 10/2012 Goetz ..... A61M 11/042 128/202.21
2012/0291791 A1 11/2012 Pradeep
2012/0304990 A1 12/2012 Todd
2013/0220315 A1 8/2013 Conley et al.
2013/0284192 A1 10/2013 Peleg et al.
2013/0311001 A1 11/2013 Hampiholi
2013/0319439 A1 12/2013 Gorelick et al.
2013/0340775 A1 12/2013 Juster et al.
2014/0078164 A1 3/2014 Chan et al.
2014/0123989 A1 5/2014 Lamothe
2014/0144429 A1 5/2014 Wensley et al.
2014/0182608 A1 7/2014 Egoyants et al.
2014/0190496 A1 7/2014 Wensley et al.
2014/0246035 A1* 9/2014 Minskoff ..... A24F 40/65 131/329
2014/0278250 A1 9/2014 Smith et al.
2014/0283859 A1 9/2014 Minskoff et al.
2014/0334804 A1 11/2014 Choi
2014/0338685 A1 11/2014 Amir
2014/0345635 A1 11/2014 Rabinowitz et al.
2014/0351913 A1 11/2014 Mcgilliard
2015/0020822 A1 1/2015 Janardhan et al.
2015/0020825 A1 1/2015 Galloway et al.
2015/0020831 A1* 1/2015 Weigensberg ..... A24F 40/90 131/329
2015/0064672 A1 3/2015 Bars
2015/0101625 A1 4/2015 Newton et al.
2015/0114407 A1 4/2015 Duncan et al.
2015/0122252 A1 5/2015 Frija
2015/0136155 A1 5/2015 Verleur et al.
2015/0136158 A1 5/2015 Stevens et al.
2015/0164144 A1 6/2015 Liu
2015/0181945 A1* 7/2015 Tremblay ..... A24F 40/60 131/328
2015/0208731 A1 7/2015 Malamud et al.
2015/0216237 A1 8/2015 Wensley et al.
2015/0257445 A1 9/2015 Henry et al.
2015/0258289 A1 9/2015 Henry et al.
2015/0272220 A1 10/2015 Spinka et al.
2015/0272223 A1 10/2015 Weigensberg et al.
2015/0288468 A1 10/2015 Xiang
2015/0305409 A1 10/2015 Verleur et al.
2015/0359263 A1 12/2015 Bellinger
2016/0004469 A1 1/2016 Yun et al.
2016/0021930 A1 1/2016 Minskoff et al.
2016/0057811 A1 2/2016 Alarcon et al.
2016/0063235 A1 3/2016 Tussy
2016/0081394 A1* 3/2016 Alarcon ..... A24F 40/40 131/328
2016/0089508 A1 3/2016 Smith et al.
2016/0106151 A1* 4/2016 Swepston ..... B23P 19/008 29/729
2016/0106936 A1 4/2016 Kimmel
2016/0143361 A1 5/2016 Juster et al.
2016/0150824 A1 6/2016 Memari et al.
2016/0157524 A1 6/2016 Bowen et al.
2016/0161459 A1 6/2016 Rouse
2016/0166786 A1 6/2016 Kinzer
2016/0198767 A1 7/2016 Verleur
2016/0198770 A1* 7/2016 Alarcon ..... A24F 40/46 392/404
2016/0219933 A1 8/2016 Henry, Jr. et al.
2016/0219938 A1 8/2016 Mamoun et al.
2016/0269375 A1 9/2016 Wu
2016/0278435 A1 9/2016 Choukroun et al.
2016/0278436 A1* 9/2016 Verleur ..... H05B 3/44
2016/0309787 A1 10/2016 Hawes et al.
2016/0331026 A1* 11/2016 Cameron ..... A24F 40/50
2016/0331036 A1 11/2016 Cameron
2016/0331859 A1 11/2016 Cameron
2016/0360789 A1 12/2016 Hawes et al.
2016/0363570 A1 12/2016 Blackley
2016/0366946 A1 12/2016 Murison et al.
2016/0367925 A1* 12/2016 Blackley ..... G08B 25/10
2016/0374399 A1* 12/2016 Monsees ..... A24F 40/60 131/329
2017/0018000 A1* 1/2017 Cameron ..... G06Q 30/0269
2017/0020191 A1 1/2017 Lamb et al.
2017/0034324 A1 2/2017 Zhang et al.
2017/0042230 A1 2/2017 Cameron
2017/0042252 A1 2/2017 Takeuchi et al.
2017/0046357 A1 2/2017 Cameron
2017/0046738 A1* 2/2017 Cameron ..... A24F 40/65
2017/0048691 A1 2/2017 Liu
2017/0086504 A1* 3/2017 Cameron ..... A24F 40/48
2017/0091853 A1* 3/2017 Cameron ..... G06Q 30/0637
2017/0092106 A1* 3/2017 Cameron ..... A24F 40/65
2017/0093981 A1* 3/2017 Cameron ..... A24F 40/65
2017/0135408 A1 5/2017 Cameron
2017/0136193 A1* 5/2017 Cameron ..... A24F 40/48
2017/0156397 A1 6/2017 Sur et al.
2017/0157341 A1 6/2017 Pandya et al.
2017/0170439 A1* 6/2017 Jarvis ..... H01M 50/578
2017/0180067 A1 6/2017 Poornachandran et al.
2017/0181474 A1 6/2017 Cameron
2017/0196270 A1 7/2017 Vick et al.
2017/0208867 A1 7/2017 Li et al.
2017/0215480 A1 8/2017 Qiu
2017/0231273 A1 8/2017 Xiang
2017/0245550 A1 8/2017 Freelander
2017/0258136 A1 9/2017 Hawes et al.
2017/0262064 A1 9/2017 Ofir et al.
2017/0266397 A1 9/2017 Mayle et al.
2017/0273357 A1 9/2017 Barbuck
2017/0304563 A1 10/2017 Adelson
2017/0304567 A1 10/2017 Adelson
2017/0318861 A1 11/2017 Thorens
2017/0360097 A1 12/2017 Xiang
2017/0368273 A1 12/2017 Rubin
2018/0020720 A1 1/2018 Matischek et al.
2018/0043114 A1 2/2018 Bowen et al.
2018/0132526 A1 5/2018 Davis et al.
2018/0153219 A1 6/2018 Verleur et al.
2018/0153221 A1 6/2018 Verleur et al.
2018/0160733 A1 6/2018 Leadley et al.
2018/0184722 A1 7/2018 Murison et al.
2018/0286208 A1 10/2018 Baker et al.
2018/0325176 A1 11/2018 Burseg
2018/0352276 A1* 12/2018 Milne ..... G06Q 20/20
2019/0095665 A1 3/2019 Sweeney et al.
2019/0104762 A1 4/2019 Cameron et al.
2019/0158938 A1* 5/2019 Bowen ..... A24F 40/65
2019/0272359 A1 9/2019 Popplewell et al.
2019/0307170 A1 10/2019 Zarifian et al.

(56) References Cited

U.S. PATENT DOCUMENTS

| | | | | |
|---|---|---|---|---|
| 2020/0000143 | A1* | 1/2020 | Anderson | G06F 3/16 |
| 2020/0058057 | A1 | 2/2020 | Ouyang | |
| 2020/0221778 | A1 | 7/2020 | Trzecieski | |

FOREIGN PATENT DOCUMENTS

| | | | |
|---|---|---|---|
| CN | 203446536 | U | 2/2014 |
| CN | 104321779 | A | 1/2015 |
| CN | 204275207 | U | 4/2015 |
| CN | 104797152 | A | 7/2015 |
| CN | 204466899 | U | 7/2015 |
| CN | 104839892 | B | 8/2015 |
| CN | 105050434 | A | 11/2015 |
| CN | 105167752 | A | 12/2015 |
| CN | 105342009 | B | 2/2016 |
| CN | 105722417 | A | 6/2016 |
| CN | 106164958 | A | 11/2016 |
| CN | 106455717 | A | 2/2017 |
| CN | 106462862 | A | 2/2017 |
| CN | 106573118 | A | 4/2017 |
| CN | 106573123 | A | 4/2017 |
| CN | 106594797 | A | 4/2017 |
| CN | 106686995 | A | 5/2017 |
| CN | 106998821 | A | 8/2017 |
| CN | 107049996 | A | 8/2017 |
| CN | 107205484 | A | 9/2017 |
| CN | 107438372 | A | 12/2017 |
| CN | 108038161 | A | 5/2018 |
| CN | 111213920 | A | 6/2020 |
| CN | 212464894 | U | 2/2021 |
| EP | 2110034 | A1 | 10/2009 |
| EP | 2399636 | A1 | 12/2011 |
| EP | 3009017 | A1 | 4/2016 |
| EP | 3000245 | B1 | 2/2018 |
| EP | 3463535 | B1 | 8/2022 |
| GB | 2507103 | A | 4/2014 |
| GB | 2527403 | A | 12/2015 |
| GR | 20120100199 | A | 11/2013 |
| JP | 2949114 | B1 | 9/1999 |
| JP | 2006180378 | A | 7/2006 |
| JP | 2007172605 | A | 7/2007 |
| JP | 2008501406 | A | 1/2008 |
| JP | 2008059382 | A | 3/2008 |
| JP | 2013088127 | A | 5/2013 |
| JP | 2013524835 | A | 6/2013 |
| JP | 2013184612 | A | 9/2013 |
| JP | 2016114402 | A | 6/2016 |
| JP | 2016152808 | A | 8/2016 |
| JP | 2017035097 | A | 2/2017 |
| JP | 2017513513 | A | 6/2017 |
| JP | 2019521739 | A | 8/2019 |
| KR | 10-2009-0119127 | A | 11/2009 |
| KR | 10-2010-0080114 | A | 7/2010 |
| KR | 101523088 | B1 | 5/2015 |
| KR | 20150064754 | A | 6/2015 |
| KR | 20210127579 | A | 10/2021 |
| RU | 2606942 | C2 | 1/2017 |
| TW | 201330884 | A | 8/2013 |
| TW | M548451 | U | 9/2017 |
| TW | I763672 | B | 5/2022 |
| WO | WO-03068300 | A1 | 8/2003 |
| WO | WO-2011160788 | A1 | 12/2011 |
| WO | WO-2014058678 | A1 | 4/2014 |
| WO | WO-2014060267 | A2 | 4/2014 |
| WO | WO-2014068504 | A2 | 5/2014 |
| WO | WO-2015031836 | A1 | 3/2015 |
| WO | WO-2015038981 | A2 | 3/2015 |
| WO | WO-2015063126 | A1 | 5/2015 |
| WO | WO-2015138560 | A1 | 9/2015 |
| WO | WO-2015161485 | A1 | 10/2015 |
| WO | WO-2015161486 | A1 | 10/2015 |
| WO | WO-2015165747 | A1 | 11/2015 |
| WO | WO-2015167000 | A1 | 11/2015 |
| WO | WO-2016008096 | A1 | 1/2016 |
| WO | WO-2016009202 | A1 | 1/2016 |
| WO | WO-2016058992 | A2 | 4/2016 |
| WO | WO-2016065413 | A1 | 5/2016 |
| WO | WO-2016075748 | A1 | 5/2016 |
| WO | WO-2016123307 | A1 | 8/2016 |
| WO | WO-2016187110 | A1 | 11/2016 |
| WO | WO-2017054627 | A1 | 4/2017 |
| WO | WO-2017055801 | A1 | 4/2017 |
| WO | WO-2017056103 | A1 | 4/2017 |
| WO | WO-2017205692 | A1 | 11/2017 |
| WO | WO-2018025217 | A1 | 2/2018 |
| WO | WO-2018092016 | A1 | 5/2018 |
| WO | WO-2020006311 | A1 | 1/2020 |

OTHER PUBLICATIONS

Behm, et al., (Jan. 1993) Clinical Evaluation of a Citric Acid Inhaler for Smoking Cessation, Drug and Alcohol Dependence, 31(2):131-138.

Pankow, James F., (May 2017) "Calculating Compound Dependent Gas-Droplet Distributions in Aerosols of Propylene Glycol and Glycerol from Electronic Cigarettes", Journal of Aerosol Science, 107:9-13.

Zhang, et al., (Aug. 31, 2017) "Preparation of Chinese Chestnut Pyrolysate and their Application to E-Cigarette", Tobacco Science & Technology, 50(8): 52-58.

* cited by examiner

| Message | Bytes | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| ActiveDock to Web-App Structure | Device ID | | | | | | Active Dock ID | | | | | | Random Session ID | | | | | | OC | | | | | | | | | | | | | |
| Web-App to ActiveDock Structure | Active Dock ID | | | | | | HMAC | | | | | | | | Resp | | | | | | | | | | | | | | | | | |
| ActiveDock to Web-App ACK | * | | | | | | | | | | | | | | | | | | | | | | | | | | | | | | | |
| ActiveDock to Web-App NACK | - | | | | | | | | | | | | | | | | | | | | | | | | | | | | | | | |

FIG. 5C

ACTIVATION OF VAPORIZER DEVICES

CROSS REFERENCE TO RELATED APPLICATIONS

This application is a bypass continuation and claims priority to PCT/US2021/017769, filed on Feb. 12, 2021 and entitled "ACTIVATION OF VAPORIZER DEVICES" which claims priority to U.S. Provisional Application No. 62/976,932, entitled "CONNECTED VAPORIZER DEVICE" and filed on Feb. 14, 2020, and U.S. Provisional Application No. 63/052,837, entitled "ACTIVATION OF VAPORIZER DEVICES" and filed on Jul. 16, 2020, the disclosures of which are incorporated herein by reference in their entirety.

TECHNICAL FIELD

The subject matter described herein relates generally to vaporizer devices and more specifically to techniques for activating a vaporizer device.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer can be provided within a cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

In some implementations, the vaporizable material can be drawn out of a reservoir and into the vaporization chamber via a wicking element (e.g., a wick). Drawing of the vaporizable material into the vaporization chamber can be at least partially due to capillary action provided by the wick as the wick pulls the vaporizable material along the wick in the direction of the vaporization chamber.

Vaporizer devices can be controlled by one or more controllers, electronic circuits (for example, sensors, heating elements), and/or the like on the vaporizer. Vaporizer devices can also wirelessly communicate with an external controller for example, a computing device such as a smartphone).

SUMMARY

In certain aspects of the current subject matter, challenges associated with activating a vaporizer device may be addressed by inclusion of one or more of the features described herein or comparable/equivalent approaches as would be understood by one of ordinary skill in the art. Aspects of the current subject matter relate to systems, methods, and articles of manufacture, including apparatuses and computer program products, for activating a vaporizer device.

In one aspect, there is provided a method that includes: receiving, by a point-of-sale (POS) device, activation data associated with a vaporizer device, the activation data received from a backend system based at least on an identifier of the vaporizer device; and communicating, by the point-of-sale device, the activation data to the vaporizer device through one or more electrical contacts on a packaging of the vaporizer device while the vaporizer device is inside the packaging, wherein the vaporizer device is activated based on the activation data.

In some variations, one or more features disclosed herein including the following features can optionally be included in any feasible combination. The point-of-sale device may receive the activation data from the backend system in response to one or more verifications being successful.

In some variations, the one or more verifications may include verifying an identity of a user of the vaporizer device and/or a purchase limit associated with the user of the vaporizer device.

In some variations, the method may further include sending, to the backend system, the identifier associated with the vaporizer device. The point-of-sale device may receive the activation data based on at least the identifier.

In some variations, the method may further include determining the identifier of the vaporizer device by at least scanning a barcode and/or a digital tag associated with the vaporizer device.

In some variations, the method may further include determining the identifier of the vaporizer device by performing one or more of an optical scan, a radio frequency identification (RFID) scan, and a near-field-communication (NFC) scan.

In some variations, the point-of-sale device may include a dock configured to receive the packaging.

In some variations, the point-of-sale device may be coupled to a dock configured to receive the packaging. The point-of-sale device may communicate the activation data to the vaporizer device via the dock.

In some variations, the one or more electrical contacts on the packaging may be electrically coupled to one or more electrical contacts on the vaporizer device.

In some variations, the one or more electrical contacts on the packaging may be electrically coupled to a universal serial bus connector coupled to a universal serial bus port of a charger dock that is coupled to the vaporizer device in the packaging.

In some variations, activating the vaporizer device may transition the vaporizer device from an inactive state in which the vaporizer device is incapable of vaporizing a vaporizable material to an active state in which the vaporizer device is capable of vaporizing the vaporizable material.

In another aspect, there is provided a method that includes: receiving, by a point-of-sale (POS) device, activation data associated with a vaporizer device, the activation data received from a backend system based at least on an identifier of the vaporizer device; and communicating, to a computing device associated with a user of the vaporizer device, the activation data, wherein the vaporizer device is activated in response to the computing device communicating the activation data to the vaporizer device.

In some variations, one or more features disclosed herein including the following features can optionally be included in any feasible combination. The point-of-sale device may communicate the activation data to the computing device by at least sending, to the computing device, the activation data in an email and/or a short messaging service (SMS) message.

In some variations, the point-of-sale device may communicate the activation data to the computing device by at least generating an output including a barcode corresponding to the activation data and/or a link for accessing the activation data.

In some variations, the computing device may further communicate the activation data to the vaporizer device via one or more audio signals or optical signals corresponding to the activation data.

In some variations, the point-of-sale device may receive the activation data from the backend system in response to one or more verifications being successful.

In some variations, the one or more verifications may include verifying an identity of a user of the vaporizer device and/or a purchase limit associated with the user of the vaporizer device.

In some variations, the method may further include sending, to the backend system, the identifier associated with the vaporizer device, wherein the point-of-sale device receives the activation data based on at least the identifier.

In some variations, the method may further include determining the identifier of the vaporizer device by at least scanning a barcode and/or a digital tag associated with the vaporizer device.

In some variations, the method may further include determining the identifier of the vaporizer device by performing one or more of an optical scan, a radio frequency identification (RFID) scan, and a near-field-communication (NFC) scan.

In some variations, activating the vaporizer device may transition the vaporizer device from an inactive state in which the vaporizer device is incapable of vaporizing a vaporizable material to an active state in which the vaporizer device is capable of vaporizing the vaporizable material.

In another aspect, there is provided an apparatus that includes: a carton having a first set of contacts disposed on an exterior surface of the carton, wherein the first set of contacts on the carton electrically couple to a second set of contacts in a vaporizer device when the vaporizer device is disposed inside the carton, wherein the electrical coupling between the first set of contacts and the second set of contacts provides a data connection between the vaporizer device inside the carton and a point-of-sale (POS) device, wherein activation data is communicated from the point-of-sale device to the vaporizer device inside the carton through the data connection, and wherein the vaporizer device is activated based at least on the activation data.

In some variations, one or more features disclosed herein including the following features can optionally be included in any feasible combination. The point-of-sale device may be coupled with a dock configured to receive the carton. The point-of-sale device may communicate the activation data to the vaporizer device through the dock while the carton is disposed inside the dock.

In some variations, the apparatus may further include a flexible substrate including the first set of contacts and a connector.

In some variations, the vaporizer device inside the carton may be coupled to a charger dock via the second set of contacts. The electrical coupling between the first set of contacts and the second set of contacts may be formed when the connector is coupled with the charger dock.

In some variations, the connector may include a universal serial bus (USB) connector.

In another aspect, there is provided a method for activating a vaporizer device. The method may include: detecting, at a computing device, a first audio signal corresponding to a first data associated with a vaporizer device; and in response to detecting the first audio signal, outputting, by the computing device, a second audio signal configured to activate the vaporizer device, the vaporizer device being activated to at least enable the vaporizer device to vaporize a vaporizable material.

In some variations, one or more features disclosed herein including the following features can optionally be included in any feasible combination. The first audio signal may be output by an apparatus coupled with the vaporizer device and/or the computing device.

In some variations, the apparatus may include a speaker configured to output the first audio signal.

In some variations, the apparatus may include a microphone configured to detect the second audio signal. The apparatus may respond to detecting the second audio signal by at least activating the vaporizer device.

In some variations, the apparatus may activate the vaporizer device by at least activating a power source and/or a heating element at the vaporizer device.

In some variations, the first data may include a first identifier associated with the vaporizer device, a second identifier associated with the apparatus, and/or a session identifier.

In some variations, the second audio signal may encodes a second data. The second data may include an identifier of the apparatus, a message authentication code, and a response.

In some variations, the apparatus may output the first audio signal in response to the vaporizer device being coupled with the apparatus.

In some variations, the apparatus may be configured to generate the first audio signal by at least applying a spread spectrum frequency shift keying and/or a forward error correction to encode the first data.

In some variations, the first data may be encoded as one or more frequencies in a human audible spectrum and/or a non-human audible spectrum.

In some variations, the apparatus may be configured to generate the first audio signal by at least encrypting the first data.

In some variations, the encrypting of the first data may include the apparatus and the computing device performing a secure key exchange to establish one or more keys for encrypting the first data.

In some variations, the apparatus may include a dock or a cartridge configured to couple with the vaporizer device.

In another aspect, there is an apparatus that includes: a speaker configured to output a first audio signal corresponding to a first data associated with a vaporizer device coupled with the apparatus; a microphone configured to detect a second audio signal output by a computing device in response to the first audio signal; and a controller configured to respond to the second audio signal by activating the vaporizer device to at least enable the vaporizer device to vaporize the vaporizable material, the vaporizer device being activated by at least activating a heating element and/or a power source of the vaporizer device.

In some variations, one or more features disclosed herein including the following features can optionally be included in any feasible combination. The controller may activate the vaporizer device by at least activating a power source and/or a heating element at the vaporizer device.

In some variations, the first data may include a first identifier associated with the vaporizer device, a second identifier associated with the apparatus, and/or a session identifier.

In some variations, the second audio signal may encode a second data. The second data may include an identifier of the apparatus, a message authentication code, and a response.

In some variations, the speaker may output the first audio signal in response to the controller detecting the vaporizer device being coupled with the apparatus.

In some variations, the first audio signal may be generated by at least applying a spread spectrum frequency shift keying and/or a forward error correction to encode the first data.

In some variations, the first data may be encoded as one or more frequencies in a human audible spectrum and/or a non-human audible spectrum.

In some variations, the first audio signal may be generated by at least encrypting the first data.

In some variations, the encrypting of the first data may include the apparatus and the computing device performing a secure key exchange to establish one or more keys for encrypting the first data.

In some variations, the apparatus may include a dock or a cartridge configured to couple with the vaporizer device.

In another aspect, there is provided a vaporizer device that includes: a heating element configured to vaporize a vaporizable material included in a reservoir of the vaporizer device and/or a cartridge coupled to with the vaporizer device; a speaker configured to output a first audio signal corresponding to a data associated with the vaporizer device; a microphone configured to detect a second audio signal output by a computing device in response to the first audio signal; and a controller configured to respond to the second audio signal by activating the vaporizer device to at least enable the vaporizer device to vaporize the vaporizable material, the vaporizer device being activated by at least activating the heating element and/or a power source of the vaporizer device.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings:

FIG. 5C depicts a format of other examples of data packets consistent with implementations of the current subject matter;

When practical, similar reference numbers denote similar structures, features, or elements.

DETAILED DESCRIPTION

Figure 1A:
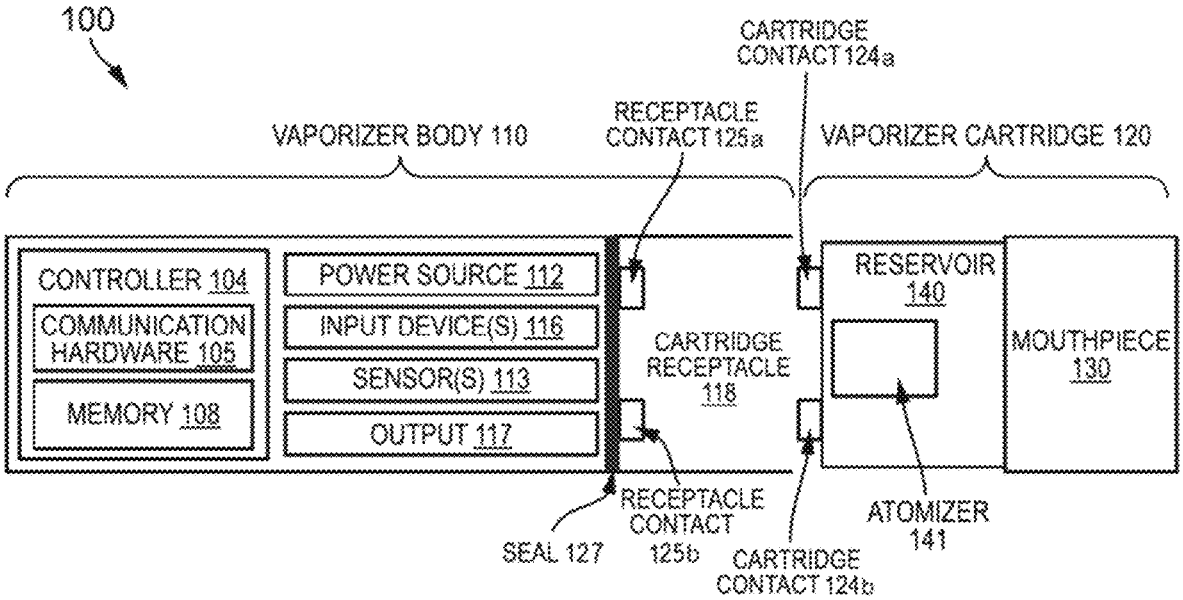
FIG. 1A depicts a block diagram illustrating an example of a vaporizer device consistent with implementations of the current subject matter.

Implementations of the current subject matter include methods, apparatuses, articles of manufacture, and systems relating to activating a vaporizer device in order to transition the vaporizer device from an inactive state in which the vaporizer device is unable to vaporize a vaporizable material to an active state in which the vaporizer device is able to vaporize the vaporizable material. The vaporizer device may be associated with activation data such as, for example, an activation code and/or the like. Activating the vaporizer device may include retrieving, based at least on an identifier of the vaporizer device, the activation data from a backend system. Moreover, activating the vaporizer device may include communicating, to the vaporizer device, the activation data.

According to various implementations of the current subject matter, activation of a vaporizer device may be performed at least partially by a point-of-sale (POS) terminal. For example, the point-of-sale terminal may, upon one or more successful verifications, receive the activation data (e.g., activation code and/or the like) associated with the vaporizer device from a backend system. The point-of-sale terminal may be configured to communicate the activation data to the vaporizer device directly or via a dock coupled with the point-of-sale terminal. Alternatively, the activation data received at the point-of-sale terminal may be communicated to the vaporizer device by a computing device associated with the user of the vaporizer device.

Implementations of the current subject matter further include methods, apparatuses, articles of manufacture, and systems relating to communication between a vaporizer device and a computing device including, for example, a computing device associated with a user of the vaporizer device. For example, the computing device may communicate, to the vaporizer device, activation data (e.g., an activation code and/or the like) associated with the vaporizer device in order to activate the vaporizer device. The computing device may communicate with the vaporizer device via a native application associated with the vaporizer device, which requires the activation data to be communicated to the vaporizer device using hardware that are only accessible to the native application (e.g., Bluetooth Low Energy (BLE), near field communication (NFC), and/or the like). Alternatively, the communication between the vaporizer device and the computing device may be performed without installing, at the computing device, a native application associated with the vaporizer device. Instead, the communication between the vaporizer device and the computing device, including the communication of the activation data, may be performed without the hardware that are accessible only to native applications (e.g., Bluetooth, near field communication (NFC), and/or the like). For instance, various implementations of the current subject matter include an audio and/or optical based communication system for exchanging various types of data between the vaporizer device and the computing device including, for example, the activation data for activating the vaporizer device.

Implementations of the current subject matter further include methods, apparatus, articles of manufacture, and systems relating to communication between a vaporizer device and a point-of-sale (POS) terminal. For example, the point-of-sale terminal may communicate, to the vaporizer device, activation data (e.g., an activation code and/or the like) associated with the vaporizer device in order to activate the vaporizer device. However, the vaporizer device may be required to remain in its packaging while the vaporizer device is being activated, for example, in a retail setting. To enable communication between the point-of-sale terminal and the vaporizer device, the vaporizer device may be disposed in packaging having one or more electrical contacts. In various implementations, the one or more electrical contacts are disposed on or adjacent to an external surface of the packaging so that the electrical contact(s) can be accessed without opening the packaging. The one or more electrical contacts on the packaging of the vaporizer device may be configured to couple to one or more corresponding electrical contacts in the vaporizer device while the vaporizer device is disposed inside the packaging. Moreover, the one or more electrical contacts on the packaging of the vaporizer device may be configured to couple to one or more electrical contacts in the point-of-sale terminal and/or a dock coupled with the point-of-sale terminal. As such, the point-of-sale terminal may communicate, through the electrical contacts in the packaging of the vaporizer device, the activation data to the vaporizer device while the vaporizer device remains in its packaging.

Example implementations include vaporizer devices and systems including vaporizer devices. In general, such vaporizer devices are hand-held devices that heat (such as by convection, conduction, radiation, and/or some combination thereof) a vaporizable material to provide an inhalable dose of the material. The vaporizable material used with a vaporizer device can be provided within a cartridge (for example, a part of the vaporizer that contains the vaporizable material in a reservoir or other container) which can be refillable when empty, or disposable such that a new cartridge containing additional vaporizable material of a same or different type can be used). A vaporizer device can be a cartridge-using vaporizer device, a cartridge-less vaporizer device, or a multi-use vaporizer device capable of use with or without a cartridge. For example, a vaporizer device can include a heating chamber (for example, an oven or other region in which material is heated by a heating element) configured to receive a vaporizable material directly into the heating chamber, and/or a reservoir or the like for containing the vaporizable material. In some implementations, a vaporizer device can be configured for use with a liquid vaporizable material (for example, a carrier solution in which an active and/or inactive ingredient(s) are suspended or held in solution, or a liquid form of the vaporizable material itself), a paste, a wax, and/or a solid vaporizable material. A solid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

The vaporizer device may be configured to couple with a vaporizer cartridge including a vaporizable material. That is, the vaporizable material may be contained in a reservoir included in the vaporizer cartridge that can be coupled (and decoupled) from the vaporizer device. Moreover, the vaporizer cartridge may be refillable when empty, or disposable such that a new cartridge containing additional vaporizable material of a same or different type can be used). Nevertheless, it should be appreciated that a power controller consistent with various implementations of the current subject matter may be compatible with any type of vaporizer device including, for example, a cartridge-based vaporizer device, a cartridge-less vaporizer device, a multi-use vaporizer device capable of use with or without a cartridge, and/or the like.

In some implementations of the current subject matter, the vaporizer device can include a heating chamber (for example, an oven or other region in which material is heated by a heating element) configured to receive a vaporizable material directly into the heating chamber, and/or a reservoir or the like for containing the vaporizable material. The vaporizer device can be configured for use with a liquid vaporizable material (for example, a carrier solution in which an active and/or inactive ingredient(s) are suspended or held in solution, or a liquid form of the vaporizable material itself), a paste, a wax, and/or a solid vaporizable material. A solid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

The vaporizer device may be configured to communicate with a computing device in order to exchange data associated with the operation of the vaporizer device. Examples of the computing device may include a smartphone, a tablet computer, a personal computer (e.g., a laptop computer), a wearable apparatus (e.g., a smartwatch), and/or the like. In some implementations of the current subject matter, the vaporizer device may communicate with the computing device in order to exchange activation data for activating the vaporizer device. For instance, the vaporizer device may be shipped in an inactive state and may transition from an active state to an inactive state under a variety of circumstances including the removal and/or insertion of a vaporizer cartridge, a period of inactivity more than a threshold length of time, and/or the like. The vaporizer device in the inactive state may be incapable of vaporizing the vaporizable material, for example, due to a power source and/or a heating element of the vaporizer device being disabled. Accordingly, the vaporizer device may require at least one activation in order to be transitioned to an active state to render the vaporizer device capable of vaporizing the vaporizable material. Alternatively and/or additionally, the vaporizer device may communicate with the computing device in order to exchange usage data. Examples of usage data may include the type of cartridge (e.g., flavor, active ingredient concentration, and/or the like), consumption level (e.g., quantity of puffs, frequency of puffs, duration of puffs, and/or the like), consumption limits, and user preferences.

The computing device may include a native application associated with the vaporizer device in order to support communication between the vaporizer device and the computing device. The native application may be developed specifically for the computing device and/or a platform of the computing device (e.g., Android, iOS, BlackBerry, Windows, and/or the like). Moreover, in order to be accessible, the native application must be downloaded and installed directly on the computing device. The exchange of data between the vaporizer device and the computing device may be performed using hardware at the computing device that is typically only accessible to the native application such as, for example, Bluetooth, near field communication (NFC), and/or the like. However, a native application associated with the vaporizer device may not always be available. Accordingly, various implementations of the current subject matter enable communication between the vaporizer device and the computing device in the absence of a native application associated with the vaporizer device. For example, the vaporizer device and the computing device may be configured to communicate via a web application that may be accessed through a web browser without being downloaded and/or installed at the computing device. The exchange of data between the vaporizer device and the computing device may be performed using hardware at the computing device that is accessible to the web browser including, for example, screen, camera, speakers, microphone, and/or the like.

In some implementations of the current subject matter, the vaporizer device and the computing device may engage in two-way communication using audio signals. For example, the vaporizer device may send audio signals to the computing device as well as receive audio signals from the computing device. The vaporizer device and/or the computing device may include hardware for audio communication such as, for example, a microphone, a speaker, and/or the like.

Alternatively and/or additionally, the vaporizer device and/or the computing device may be coupled to an apparatus that includes hardware for audio communication. The apparatus may be configured to couple to the vaporizer device such as, for example, a dock, a cartridge, and/or the like. Meanwhile, the data that is exchanged between the vaporizer device and the computing device may be encoded as audio signals in frequencies that are within the human audible spectrum (e.g., >17 kilohertz) and/or outside of the human audible spectrum. For instance, in order to transmit data from the computing device to the vaporizer device, the computing device and/or the apparatus may encode the data using a variety of techniques including, for example, spread spectrum frequency shift keying (FSK), forward error correction, and/or the like. The vaporizer device and/or the apparatus may preprocess the audio signal to minimize background noise (e.g., by applying broad-band filtering, noise cancellation, blind source separation, and/or the like) before decoding the audio signal.

In some implementations of the current subject matter, the vaporizer device and the computing device may engage in two-way communication using optical signals. For example, the vaporizer device may send optical signals to the computing device as well as receive optical signals from the computing device. The vaporizer device and/or the computing device may include hardware for optical communication including, for example, an optical transmitter (e.g., light emitting diodes (LEDs)), an optical receiver (e.g., camera), and/or the like. Alternatively and/or additionally, the vaporizer device and/or the computing device may be coupled to an apparatus (e.g., a dock, a cartridge, and/or the like) that includes hardware for optical communication. It should be appreciated that a variety of techniques may be applied, for example, by the vaporizer device, the computing device, and/or the apparatus, in order to encode and/or decode optical signals.

In some implementations of the current subject matter, the transmission link (e.g., audio link, optical link, and/or the like) between the vaporizer device, the computing device, and/or the apparatus may be secured using a variety of techniques including, for example, session based ephemeral keys. The data that is exchanged between the vaporizer device and the computing device may be encrypted using a symmetric encryption technique or asymmetric encryption technique including, for example, advanced encryption standard (AES) cryptography, elliptic curve cryptography (EEC), Rivest-Shamir-Adleman (RSA) cryptography, and/or the like. Meanwhile, the keys used for encrypting the data exchanged between the vaporizer device, the computing device, and/or the apparatus may be established using a variety of secure exchange techniques including, for example, Diffie-Hellman and/or the like.

FIG. 1A depicts a block diagram illustrating an example of a vaporizer device 100 consistent with implementations of the current subject matter. Referring to FIG. 1A, the vaporizer device 100 can include a power source 112 (for example, a battery, which can be a rechargeable battery), and a controller 104 (for example, a processor, circuitry, etc. capable of executing logic) for controlling delivery of heat to an atomizer 141 to cause a vaporizable material 102 to be converted from a condensed form (such as a solid, a liquid, a solution, a suspension, a part of an at least partially unprocessed plant material, etc.) to the gas phase. The controller 104 can be part of one or more printed circuit boards (PCBs) consistent with certain implementations of the current subject matter. After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The atomizer 141 in the vaporizer device 100 can be configured to vaporize a vaporizable material 102. The vaporizable material 102 can be a liquid. Examples of the vaporizable material 102 include neat liquids, suspensions, solutions, mixtures, and/or the like. The atomizer 141 can include a wicking element (i.e., a wick) configured to convey an amount of the vaporizable material 102 to a part of the atomizer 141 that includes a heating element (not shown in FIG. 1A).

For example, the wicking element can be configured to draw the vaporizable material 102 from a reservoir 140 configured to contain the vaporizable material 102, such that the vaporizable material 102 can be vaporized by heat delivered from a heating element. The wicking element can also optionally allow air to enter the reservoir 140 and replace the volume of vaporizable material 102 removed. In some implementations of the current subject matter, capillary action can pull vaporizable material 102 into the wick for vaporization by the heating element, and air can return to the reservoir 140 through the wick to at least partially equalize pressure in the reservoir 140. Other methods of allowing air back into the reservoir 140 to equalize pressure are also within the scope of the current subject matter.

As used herein, the terms "wick" or "wicking element" include any material capable of causing fluid motion via capillary pressure.

The heating element can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, the atomizer 141 can include a heating element which includes a resistive coil or other heating element wrapped around, positioned within, integrated into a bulk shape of, pressed into thermal contact with, or otherwise arranged to deliver heat to a wicking element, to cause the vaporizable material 102 drawn from the reservoir 140 by the wicking element to be vaporized for subsequent inhalation by a user in a gas and/or a condensed (for example, aerosol particles or droplets) phase. Other wicking elements, heating elements, and/or atomizer configurations are also possible.

Certain vaporizer devices may, additionally or alternatively, be configured to create an inhalable dose of the vaporizable material 102 in the gas phase and/or aerosol phase via heating of the vaporizable material 102. The vaporizable material 102 can be a solid-phase material (such as a wax or the like) or plant material (for example, tobacco leaves and/or parts of tobacco leaves). In such vaporizer devices, a resistive heating element can be part of, or otherwise incorporated into or in thermal contact with, the walls of an oven or other heating chamber into which the vaporizable material 102 is placed. Alternatively, a resistive heating element or elements can be used to heat air passing through or past the vaporizable material 102, to cause convective heating of the vaporizable material 102. In still other examples, a resistive heating element or elements can be disposed in intimate contact with plant material such that direct conductive heating of the plant material occurs from within a mass of the plant material, as opposed to only by conduction inward from walls of an oven.

The heating element can be activated in association with a user puffing (i.e., drawing, inhaling, etc.) on a mouthpiece 130 of the vaporizer device 100 to cause air to flow from an air inlet, along an airflow path that passes the atomizer 141 (i.e., wicking element and heating element). Optionally, air can flow from an air inlet through one or more condensation areas or chambers, to an air outlet in the mouthpiece 130. Incoming air moving along the airflow path moves over or through the atomizer 141, where vaporizable material 102 in the gas phase is entrained into the air. The heating element can be activated via the controller 104, which can optionally be a part of a vaporizer body 110 as discussed herein, causing current to pass from the power source 112 through a circuit including the resistive heating element, which is optionally part of a vaporizer cartridge 120 as discussed herein. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece 130) for inhalation by a user.

Activation of the heating element can be caused by automatic detection of a puff based on one or more signals generated by one or more of a sensor 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

In some implementations of the current subject matter, the vaporizer device 100 may be configured to communicate with another device including, for example, a computing device associated with a user of the vaporizer device 100, a point-of-sale (POS) terminal, and/or the like The other device may be a component of a vaporizer system that also includes the vaporizer device 100, and can include its own hardware for communication, which can establish a wireless communication channel with the communication hardware 105 of the vaporizer device 100. For example, the other device used as part of a vaporizer system can include a general-purpose computing device (e.g., a smartphone, a tablet computer, a personal computer, a wearable device, and/or the like) that executes software to produce a user interface for enabling a user to interact with the vaporizer device 100. In other implementations of the current subject matter, the other device used as part of a vaporizer system can be a dedicated piece of hardware such as a point-of-sale (POS) terminal, a remote control, or another wireless or wired device having one or more physical or soft (i.e., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

The vaporizer device 100 may communicate with another device in order to exchange activation data for activating the vaporizer device 100. For example, the vaporizer device 100 may be shipped in an inactive state and/or may transition from an active state to an inactive state under a variety of circumstances including the removal and/or insertion of a vaporizer cartridge, a period of inactivity more than a threshold length of time, and/or the like. The vaporizer device 100 in the inactive state may be incapable of vaporizing the vaporizable material 102, for example, due to a disabling of the power source 112. Accordingly, the vaporizer device 100 may be subject to at least one activation in order to be transitioned to an active state to render the vaporizer device 100 capable of vaporizing the vaporizable material 102. For instance, according to some implementations of the current subject matter, the initial activation of the vaporizer device 100 may be performed at least partially by a point-of-sale (POS) terminal. Subsequent to the initial activation, the vaporizer device 100 may remain in the active state or transition from the active state to the inactive state in response to, for example, the removal and/or insertion of a vaporizer cartridge, a period of inactivity more than a threshold length of time, and/or the like.

As noted, the vaporizer device 100 may undergo at least one activation, for example, an initial activation, in order to render the vaporizable device capable of vaporizing the vaporizable material 102. In some implementations of the current subject matter, the activation of the vaporizer device 100 may be contingent upon one or more successful verifications including, for example, an identity (e.g., age) of a user of the vaporizer device 100, a purchase limit associated with the user of the vaporizer device 100, an authenticity of the cartridge 120, a location of the vaporizer device 100 (e.g., threshold distance away from restriction zones), and/or the like. For example, upon one or more successful verifications, the point-of-sale terminal may receive, based at least on an identifier of the vaporizer device 100, an activation data (e.g., an activation code and/or the like) from a backend system storing the activation data. The vaporizer device 100 may be activated when the activation data is communicated to the vaporizer device 100 by the point-of-sale terminal and/or a computing device associated with a user of the vaporizer device 100. For instance, the controller 104 at the vaporizer device 100 may respond to the activation data (e.g., being received by the communication hardware 105) by activating the vaporizer device 100, which may include activating the power source 112 and/or a heating element (e.g., included in the atomizer 141).

Alternatively and/or additionally, the vaporizer device 100 may communicate with another device in order to exchange usage data. For example, the vaporizer device 100 may exchange usage data with a computing device associated with a user of the vaporizer device 100. Examples of usage data may include the type of cartridge (e.g., flavor, active ingredient concentration, and/or the like), consumption level (e.g., quantity of puffs, frequency of puffs, duration of puffs, and/or the like), consumption limits, and user preferences. In some implementations of the current subject matter, the temperature of the heating of element of the vaporizer device 100 may be adjusted based at least on the usage data. For instance, the temperature of the heating element included in the atomizer 141 of the vaporizer device 100 may be increased (or decreased) in order to adjust temperature at which the vaporizer device 100 operates to vaporize the vaporizable material 102 such that a flavor profile of the resulting vapor is consistent with the usage data.

The temperature of the heating element of the vaporizer device 100 can depend on a number of factors, including a quantity of electrical power delivered to the resistive heating element and/or a duty cycle at which the electrical power is delivered, conductive heat transfer to other parts of the electronic vaporizer device 100 and/or to the environment, latent heat losses due to vaporization of the vaporizable material 102 from the wicking element and/or the atomizer 141 as a whole, and convective heat losses due to airflow (i.e., air moving across the heating element or the atomizer 141 as a whole when a user inhales on the vaporizer device 100). As noted herein, to reliably activate the heating element or heat the heating element to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element can be activated in association with a user's puff, for example by automatic detection of the puff, or by the sensor 113 detecting a change (such as a pressure change) in the airflow path.

The sensor 113 can be positioned on or coupled to (i.e., electrically or electronically connected, either physically or via a wireless connection) the controller 104 (for example, a printed circuit board or other type of circuit board). To take measurements accurately and maintain durability of the vaporizer device 100, it can be beneficial to provide a seal 127 resilient enough to separate an airflow path from other parts of the vaporizer device 100. The seal 127, which can be a gasket, can be configured to at least partially surround the sensor 113 such that connections of the sensor 113 to the internal circuitry of the vaporizer device 100 are separated from a part of the sensor 113 exposed to the airflow path. In an example of a cartridge-based vaporizer, the seal 127 can also separate parts of one or more electrical connections between the vaporizer body 110 and the vaporizer cartridge 120. Such arrangements of the seal 127 in the vaporizer device 100 can be helpful in mitigating against potentially disruptive impacts on vaporizer components resulting from interactions with environmental factors such as water in the vapor or liquid phases, other fluids such as the vaporizable material 102, etc., and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, excess vaporizable material 102, etc., in parts of the vaporizer device 100 where they can result in poor pressure signal, degradation of the sensor 113 or other components, and/or a shorter life of the vaporizer device 100. Leaks in the seal 127 can also result in a user inhaling air that has passed over parts of the vaporizer device 100 containing, or constructed of, materials that may not be desirable to be inhaled.

In some implementations, the vaporizer body 110 includes the controller 104, the power source 112 (for example, a battery), one more of the sensor 113, charging contacts (such as those for charging the power source 112), the seal 127, and a cartridge receptacle 118 configured to receive the vaporizer cartridge 120 for coupling with the vaporizer body 110 through one or more of a variety of attachment structures. In some examples, the vaporizer cartridge 120 includes the reservoir 140 for containing the vaporizable material 102, and the mouthpiece 130 has an aerosol outlet for delivering an inhalable dose to a user. The vaporizer cartridge 120 can include the atomizer 141 having a wicking element and a heating element. Alternatively, one or both of the wicking element and the heating element can be part of the vaporizer body 110. In implementations in which any part of the atomizer 141 (i.e., heating element and/or wicking element) is part of the vaporizer body 110, the vaporizer device 100 can be configured to supply vaporizable material 102 from the reservoir 140 in the vaporizer cartridge 120 to the part(s) of the atomizer 141 included in the vaporizer body 110.

Cartridge-based configurations for the vaporizer device 100 that generate an inhalable dose of a vaporizable material 102 that is not a liquid, via heating of a non-liquid material, are also within the scope of the current subject matter. For example, the vaporizer cartridge 120 can include a mass of a plant material that is processed and formed to have direct contact with parts of one or more resistive heating elements, and the vaporizer cartridge 120 can be configured to be coupled mechanically and/or electrically to the vaporizer body 110 that includes the controller 104, the power source 112, and one or more receptacle contacts 125 configured to connect to one or more corresponding cartridge contacts 124 and complete a circuit with the one or more resistive heating elements. In the example of the vaporizer device 100 and vaporizer cartridge 120 shown in FIG. 1A, the one or more receptacle contacts 125 may include a first receptacle contact 125*a* and a second receptacle contact 125*b* configured to couple to a first cartridge contact 124*a* and a second cartridge contact 124*b*. However, it should be appreciated that the vaporizer body 110 may include a different quantity of receptacle contacts 125 configured to couple to a corresponding quantity of cartridge contacts 124. For instance, in some implementations of the current subject matter, the vaporizer body 110 may include four receptacle contacts 125 configured to couple to four corresponding cartridge contacts 124 in the vaporizer cartridge 120. The circuit completed by coupling the one or more receptacle contacts 125 and the one or more cartridge contacts 124 can allow delivery of electrical current to a heating element and can further be used for additional functions, such as measuring a resistance of the heating element for use in determining and/or controlling a temperature of the heating element based on a thermal coefficient of resistivity of the heating element.

Figure 1B:
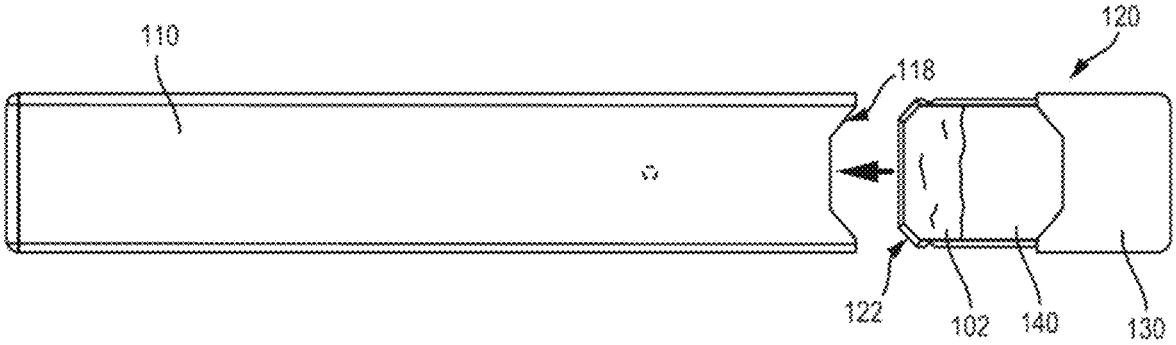
FIG. 1B depicts a top view of an example of a vaporizer device and a vaporizer cartridge consistent with implementations of the current subject matter.
Figure 1C:
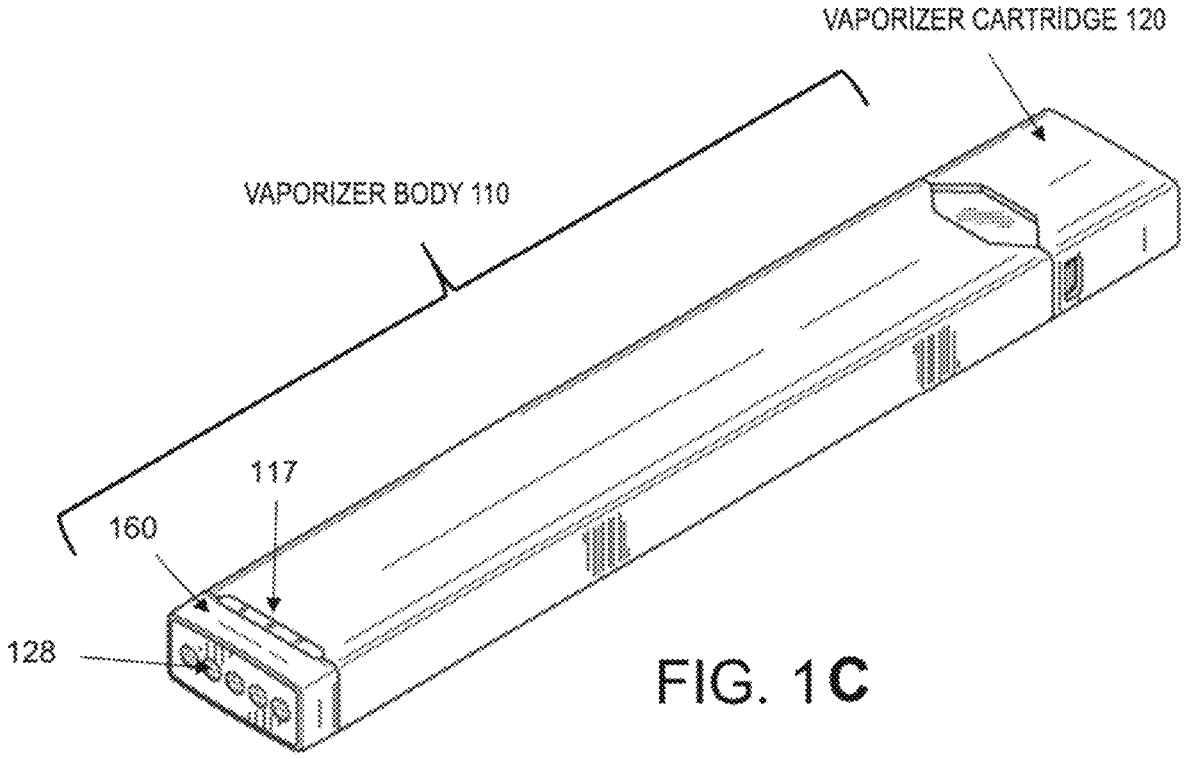
FIG. 1C depicts a perspective view of an example of a vaporizer cartridge coupled to a vaporizer device consistent with implementations of the current subject matter.

FIG. 1B depicts a top view of an example of the vaporizer device 100 and the vaporizer cartridge 120 consistent with implementations of the current subject matter. As shown in FIG. 1B, of the vaporizer cartridge 120 may be releasably inserted into the cartridge receptacle 118 of the vaporizer body 110. In the example shown in FIG. 1B, the vaporizer cartridge 120 is positioned for insertion into the vaporizer body 110. Meanwhile, FIG. 1C depicts a perspective view of the vaporizer device 100 having the vaporizer cartridge 120 inserted (e.g., releasably) into the cartridge receptacle 118 of the vaporizer body 110. When a user puffs on the vaporizer device 100, air can pass between an outer surface of the vaporizer cartridge 120 and an inner surface of the cartridge receptacle 118 on the vaporizer body 110. Air can then be drawn into the insertable end 122 of the cartridge, through the vaporization chamber that includes or contains the heating element and wick, and out through an outlet of the mouthpiece 130 for delivery of the inhalable aerosol to a user. The reservoir 140 of the vaporizer cartridge 120 can be formed in whole or in part from translucent material such that a level of the vaporizable material 102 is visible within the vaporizer cartridge 120. The mouthpiece 130 can be a separable component of the vaporizer cartridge 120 or can be integrally formed with other component(s) of the vaporizer cartridge 120 (for example, formed as a unitary structure with the reservoir 140 and/or the like).

Further to the discussion above regarding the electrical connections between the vaporizer cartridge 120 and the vaporizer body 110 being reversible such that at least two rotational orientations of the vaporizer cartridge 120 in the cartridge receptacle 118 are possible, in some embodiments of the vaporizer device 100, the shape of the vaporizer cartridge 120, or at least a shape of the insertable end 122 of the vaporizer cartridge 120 that is configured for insertion into the cartridge receptacle 118, can have rotational symmetry of at least order two. In other words, the vaporizer cartridge 120 or at least the insertable end 122 of the vaporizer cartridge 120 can be symmetrical upon a rotation of 180° around an axis along which the vaporizer cartridge 120 is inserted into the cartridge receptacle 118. In such a configuration, the circuitry of the vaporizer device 100 can support identical operation regardless of which symmetrical orientation of the vaporizer cartridge 120 occurs.

Referring again to FIG. 1C, the vaporizer device 100 can include one or more output features 117 configured to provide a visual indicator, an audio indicator, and/or a haptic indicator of a status, mode of operation, and/or the like, of the vaporizer device 100. In some aspects, the one or more output features 117 can include a plurality of LEDs (i.e., two, three, four, five, or six LEDs). The one or more output feature 117 (i.e., each individual LED) can be configured to display light in one or more colors (for example, white, red, blue, green, yellow, etc.). Alternatively and/or additionally, the one or more output features 117 can be configured to display different light patterns (for example, by illuminating specific LEDs, varying a light intensity of one or more of the LEDs over time, illuminating one or more LEDs with a different color, and/or the like) corresponding to different statuses, modes of operation, and/or the like of the vaporizer device 100. In the example shown in FIG. 1C, the one or more output features 117 can be proximal to and/or at least partially disposed within a bottom end region 160 of the vaporizer device 100. Further as shown in FIG. 1C, the vaporizer device 100 may, additionally or alternatively, include externally accessible charging contacts 128, which can be proximate to and/or at least partially disposed within the bottom end region 160 of the vaporizer device 100.

As noted, the vaporizer device 100 may communicate with another device including, for example, a point-of-sale (POS) terminal, a computing device associated with a user of the vaporizer device 100, and/or the like. The vaporizer device 100 may communicate with the other device in order to exchange data including, for example, activation data, usage data, and/or the like. For example, the vaporizer device 100 may undergo one or more activations in order to transition from an inactive state in which the vaporizer device 100 is incapable of vaporizing the vaporizable material 102 to an active state in which the vaporizer device 100 is capable of vaporizing the vaporizable material 102. Activating the vaporizer device 100 may include retrieving and communicating, to the vaporizer device 100, activation data (e.g., activation code and/or the like) associated with the vaporizer device 100. Moreover, according to some implementations of the current subject matter, activation of the vaporizer device 100 may be performed at least in part by a point-of-sale (POS) terminal. For instance, the point-of-sale terminal may, upon one or more successful verifications, receive the activation data (e.g., activation code and/or the like) associated with the vaporizer device 100 from a backend system. The point-of-sale terminal, which may be a dock or include a dock coupled with a point-of-sale device (e.g., a tablet computer and/or the like), may communicate the activation data to the vaporizer device 100. Alternatively, the activation data received at the point-of-sale terminal may be communicated to the vaporizer device 100 by a computing device associated with the user of the vaporizer device 100.

Figure 8:
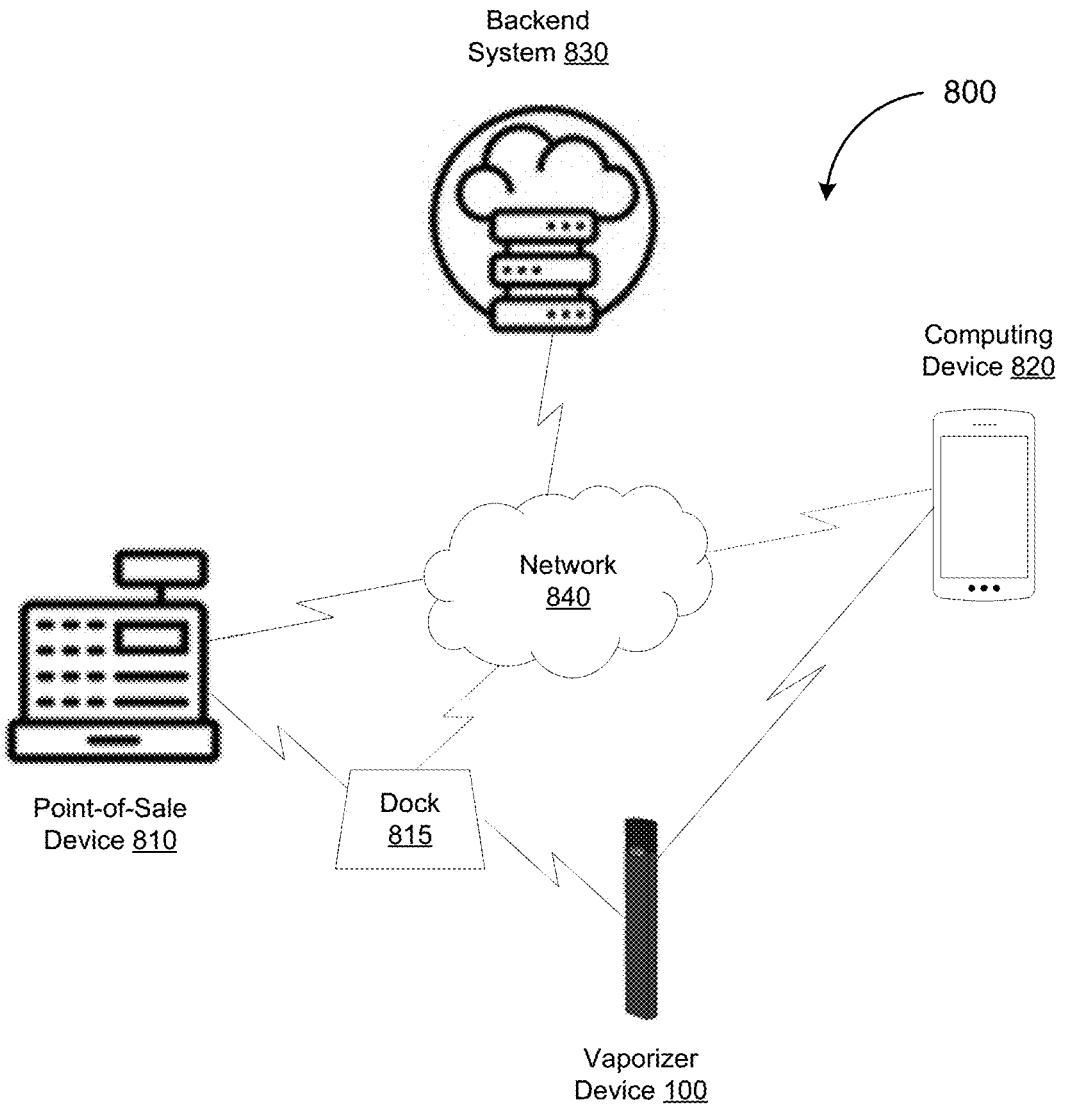
FIG. 8 depicts a system diagram illustrating an example of an activation system consistent with implementations of the current subject matter.

To further illustrate, FIG. 8 depicts a system diagram illustrating an example of an activation system 800 consistent with implementations of the current subject matter. Referring to FIG. 8, the activation system 800 may include a point-of-sale device 810, a dock 815, a computing device 820, a backend system 830 (e.g., one or more servers, external databases, and/or the like), and the vaporizer device 100.

In some implementations of the current subject matter, activation of the vaporizer device 100 may be performed at least partially by the point-of-sale device 810 and/or the dock 815. Moreover, in order to activate the vaporizer device 100, the point-of-sale device 810 and/or the dock 815 may communicate with the backend system 830 via a network 840. It should be appreciated that the network 840 may be a wired network and/or a wireless network including, for example, a local area network (LAN), a virtual local area network (VLAN), a wide area network (WAN), a public land mobile network (PLMN), the Internet, and/or the like. The point-of-sale (POS) device 810 may include one or more devices configured to process payments including, for example, a register, a payment card reader, a barcode reader, a computing device, and/or the like. For example, the point-of-sale device 810 may include a tablet computer that is further coupled to the vaporizer device 100 via the dock 815. Alternatively, the point-of-sale device 810 and the dock 815 may each be configured to couple to the vaporizer device 100 directly.

Activation of the vaporizer device 100 may be contingent upon one or more successful verifications including, for example, an identity verification, a purchase limit verification, and/or the like. For example, activation of the vaporizer device 100 may require confirmation that a user purchasing the vaporizer device 100 is of a threshold age and has not purchased more than a threshold quantity of vaporizer devices within a certain period of time. As noted, the one or more verifications may be performed at least partially by the point-of-sale device 810. For instance, the point-of-sale device 810 may perform one or more scans (e.g., an optical scan, a magnetic scan, a near-field-communication (NFC) scan, a radio frequency identification (RFID) scan, and/or the like) of an identification card of the user purchasing the vaporizer device 100 in order to determine one or more identification information associated with the user. Moreover, the point-of-sale device 810 may send, to the backend system 830, at least a portion of the identification information such that the backend system 830 may verify, based at least on the identification information, an identity of the user, a purchase limit associated with the user, and/or the like.

Upon one or more successful verifications, the point-of-sale device 810 may receive, from the backend system 830, activation data (e.g., an activation code) associated with the vaporizer device 100. For example, the backend system 830 may store the activation data associated with the vaporizer device 100 including by storing a mapping between the activation data and an identifier (e.g., a serial number and/or the like) of the vaporizer device 100. Upon successfully verifying the identity of the user, the purchase limit associated with the user, and/or the like, the backend system 830 may prompt the point-of-sale device 810 to send, to the backend system 830, the identifier of the vaporizer device 100.

The identifier of the vaporizer device 100 and/or a representation of the identifier of the vaporizer device 100 (e.g., a barcode) may be included in a packaging of the vaporizer device 100. For example, a barcode (e.g., a Quick Response (QR) code) corresponding to the identifier of the vaporizer device 100 may be disposed on an exterior surface of the packaging of the vaporizer device 100. Alternatively, a digital tag (e.g., a radio frequency identification (RFID) tag, a near-field communication (NFC) tag, and/or the like) storing the identifier of the vaporizer device 100 may be included in the packaging of the vaporizer device 100. Accordingly, the point-of-sale device 810 may perform one or more scans (e.g., an optical scan, a magnetic scan, a near-field-communication (NFC) scan, a radio frequency identification (RFID) scan, and/or the like) in order to determine the identifier of the vaporizer device 100. Furthermore, the point-of-sale device 810 may send, to the backend system 830, the identifier (e.g., serial number and/or the like) of the vaporizer device 100. In response to receiving the identifier of the vaporizer device 100 from the point-of-sale device 810, the backend system 830 may send, to the point-of-sale device 810, the activation data associated with the vaporizer device 100.

Referring again to FIG. 8, activation of the vaporizer device 100 may further include communicating, to the vaporizer device 100, the activation data received from the backend system 830. In some implementations of the current subject matter, the activation data (e.g., activation code and/or the like) associated with the vaporizer device 100 may be communicated to the vaporizer device 100 by the point-of-sale device 810 and/or the dock 815 coupled with the point-of-sale device 810. Alternatively and/or additionally, the point-of-sale device 810 may communicate, to the computing device 820, the activation data associated with the vaporizer device 100 before the computing device 820 further communicates the activation data to the vaporizer device 100. The point-of-sale device 810 may send the activation data to the computing device 820, for example, via the network 840. Alternatively, the activation data may be input into and/or retrieved by the computing device 820 based on an output from the point-of-sale device 810 that includes, for example, the activation data, a representation (e.g., a barcode and/or the like) of the activation data, a link (e.g., a hyperlink) to the activation data, and/or the like.

As noted, the point-of-sale device 810 and/or the dock 815 coupled with the point-of-sale device 810 may be configured to communicate, to the vaporizer device 100, the activation data associated with the vaporizer device 100. However, the vaporizer device 100 may be required to remain in its packaging while the vaporizer device 100 is being activated in a retail setting. To enable communication between the point-of-sale device 810 and the vaporizer device 100 inside its packaging, the vaporizer device may be disposed in packaging having one or more electrical contacts. The one or more electrical contacts on the packaging of the vaporizer device 100 may be configured to couple to one or more corresponding electrical contacts in the vaporizer device 100, for example, the charging contacts 128, while the vaporizer device 100 is disposed inside the packaging. Moreover, the one or more electrical contacts in the packaging of the vaporizer device 100 may be configured to couple to one or more electrical contacts in the point-of-sale device 810 and/or the dock 815 coupled with the point-of-sale device 810.

Figure 9A:
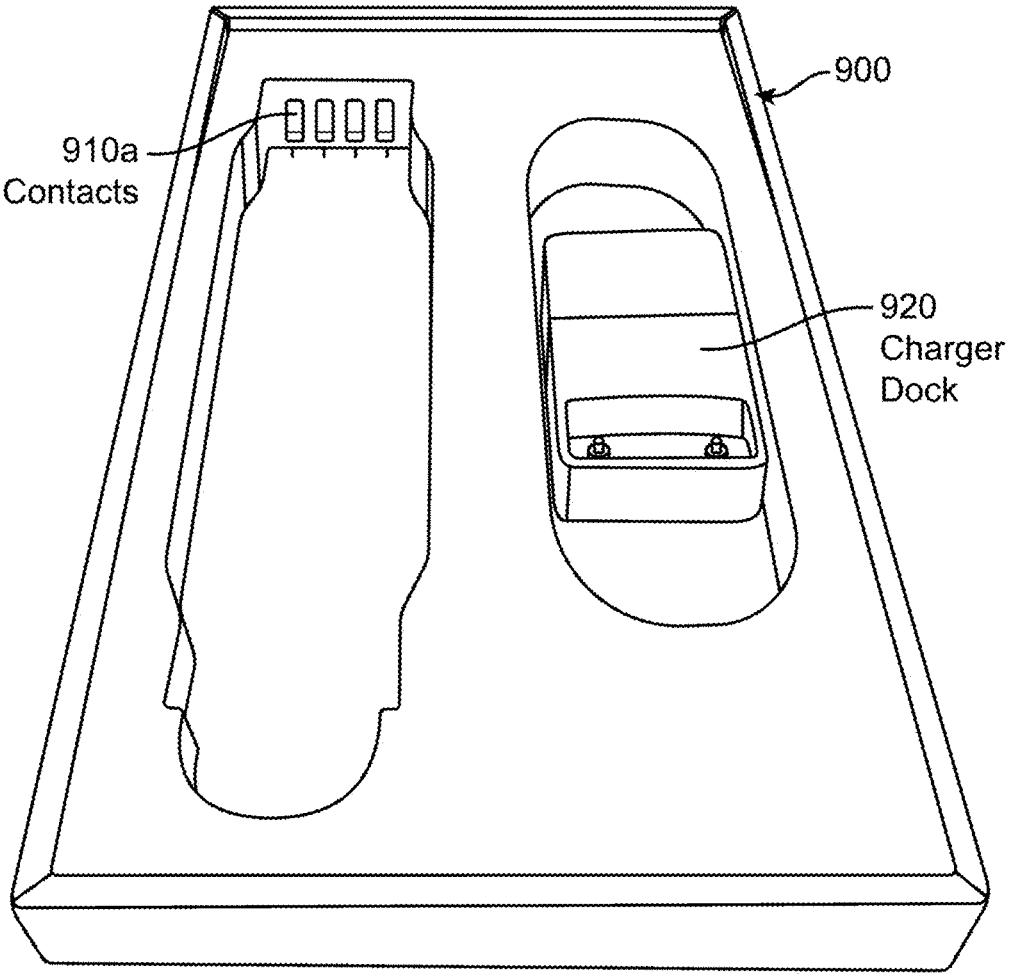
FIG. 9A depicts an example of a packaging consistent with implementations of the current subject matter.
Figure 9B:
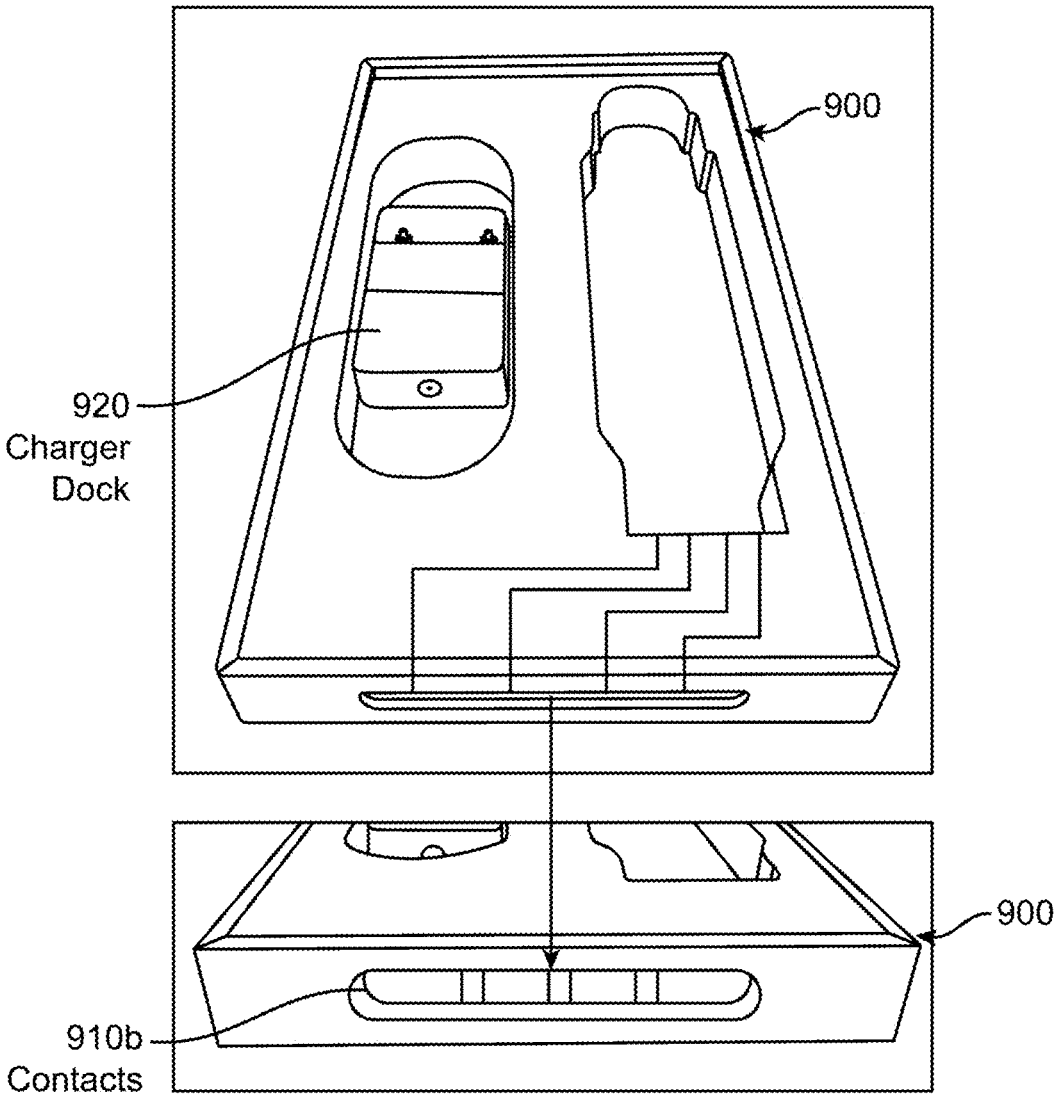
FIG. 9B depicts an example of a packaging consistent with implementations of the current subject matter.

FIGS. 9A-B depict an example of a packaging 900 consistent with implementations of the current subject matter. Referring to FIGS. 9A-B, the interior of the packaging 900 may include one or more contacts 910*a* configured to couple directly to the vaporizer device 100, for example, the charging contacts 128 in the vaporizer device 100, when the vaporizer device 100 is disposed inside the packaging 900. Furthermore, the exterior surface of the packaging 900 may include one or more contacts 910*b* configured to couple to one or more corresponding contacts in the point-of-sale device 810 and/or the dock 815. As shown in FIG. 9B, the contacts 910*a* are further coupled to the contacts 910*b* to provide conduit data connection between the vaporizer device 100 and the point-of-sale device 810 and/or the dock 815. Accordingly, the point-of-sale device 810 and/or the dock 815 may communicate, through the contacts 910*a* and the contacts 910*b* in the packaging 900, the activation data to the vaporizer device 100 without removing the vaporizer device 100 from the packaging 900.

Figure 11A:
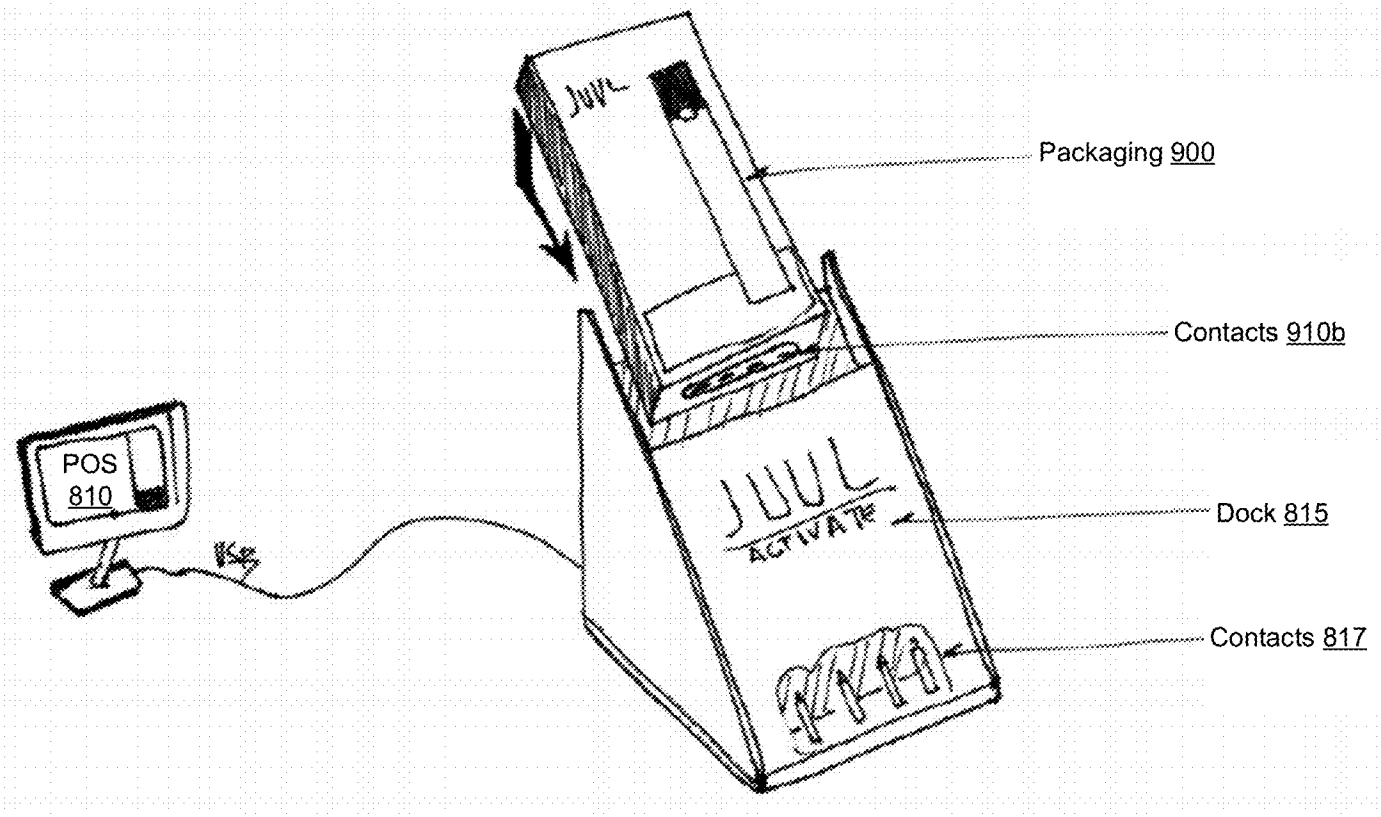
FIG. 11A depicts an example of a dock consistent with implementations of the current subject matter.
Figure 11B:
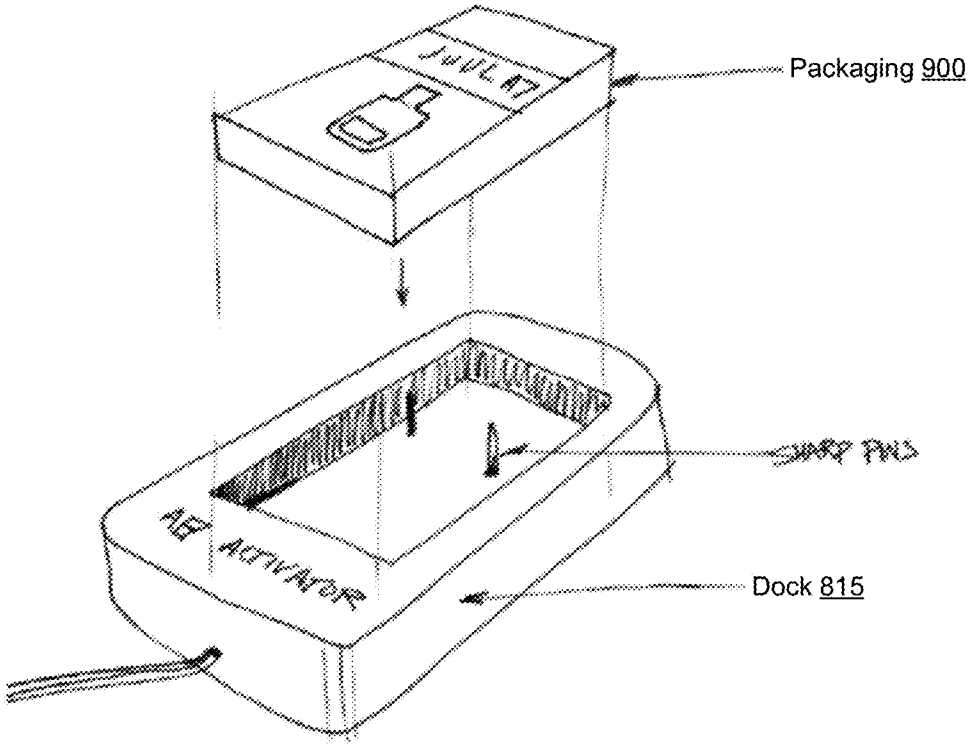
FIG. 11B depicts another example of a dock consistent with implementations of the current subject matter.

To further illustrate, FIGS. 11A-B show that the vaporizer device 100 inside the packaging 900 may be coupled with the dock 815 in order for the point-of-sale device 810 to communicate the activation data to the vaporizer device 100. For instance, FIG. 11A shows that when the packaging 900 including the vaporizer device 100 may be disposed at least partially inside the dock 815 such that the contacts 910*b* on the exterior surface of the packaging 900 may couple with the corresponding contacts 817 in the dock 815.

Figure 10A:
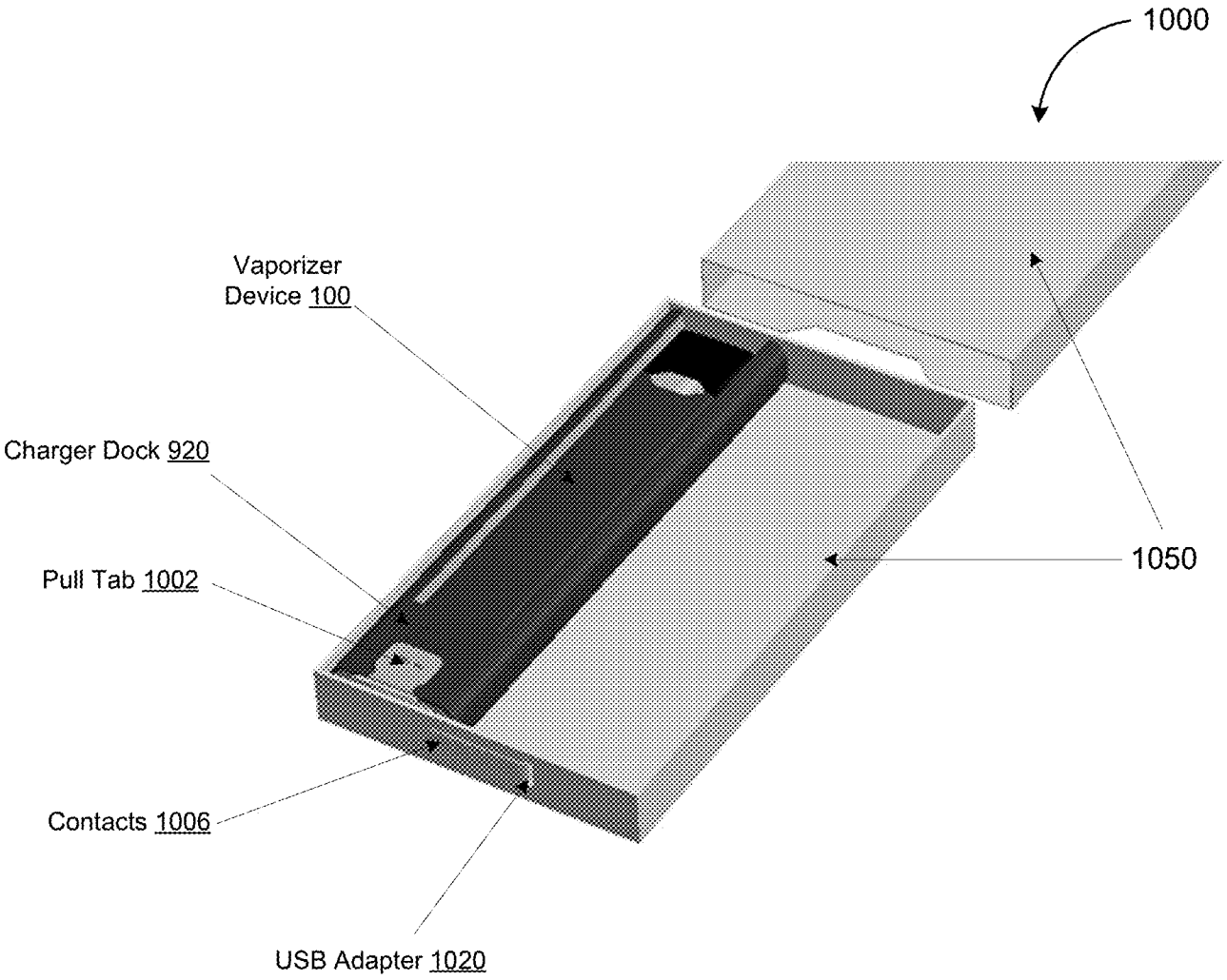
FIG. 10A depicts an example of a packaging consistent with implementations of the current subject matter.
Figure 10B:
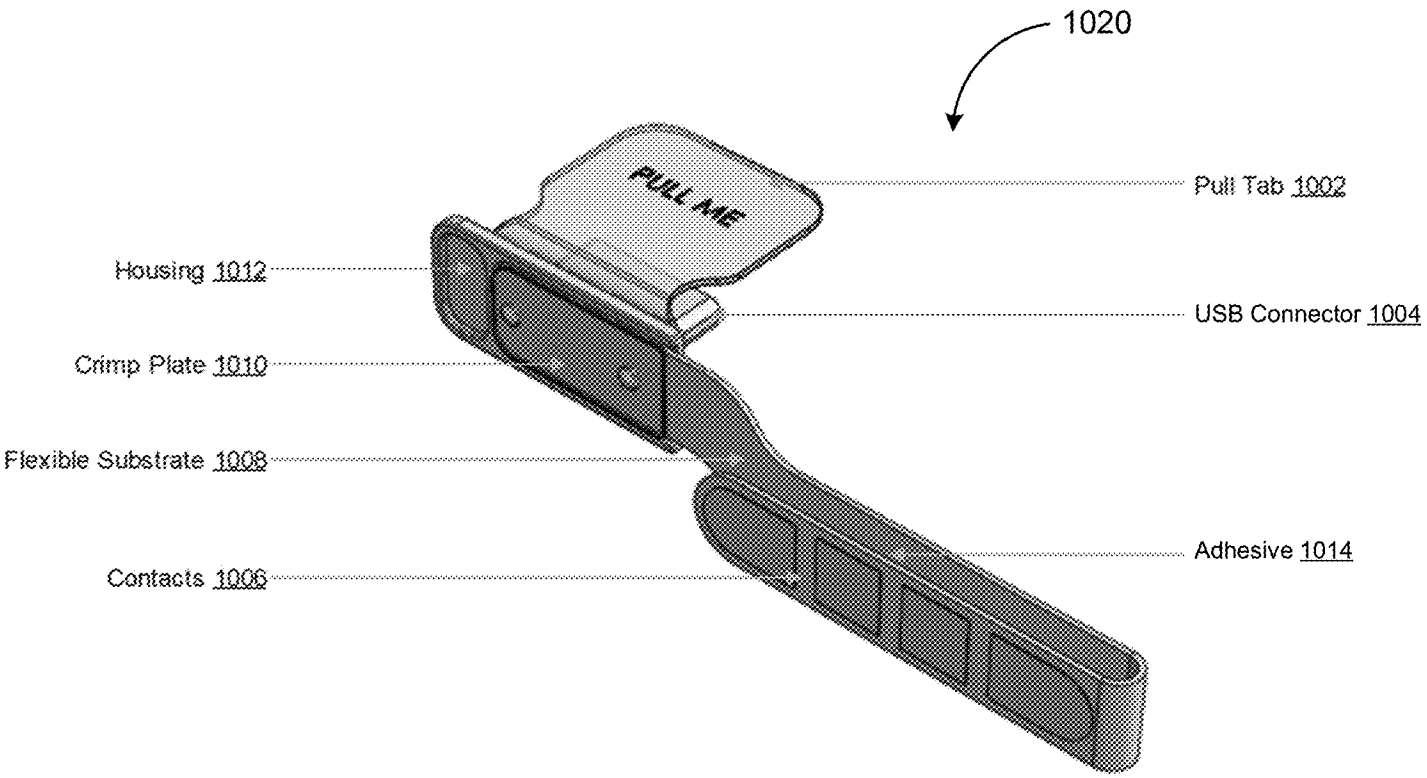
FIG. 10B depicts an example of a universal serial bus (USB) adapter consistent with implementations of the current subject matter.

FIGS. 10A-B depict an example of a packaging 1000 having a universal serial bus adapter 1020 consistent with implementations of the current subject matter. As shown in FIGS. 10A-B, the charger dock 920 may be coupled with the vaporizer device 100 inside the packaging 1000. Accordingly, instead of having contacts configured to couple directly with the charging contacts 128 of the vaporizer device 100, the example of the packaging 1000 shown in FIGS. 10A-B may include the universal serial bus (USB) adapter 1020 configured to couple with the charger dock 920. It should be appreciated that a universal serial bus (USB) connection may be one example of a data connection between the vaporizer device 100 and the point-of-sale device 810 (and/or the dock 815).

Referring again to FIGS. 10A-B, the universal serial bus adapter 1020 may include a housing 1012 containing a universal serial bus (USB) connector 1004 that is coupled, via crimp plate 1020, to a flexible substrate 1008 including one or more contacts 1006 configured to couple with one or more corresponding contacts in the point-of-sale device 810 and/or the dock 815 coupled with the point-of-sale device 810. In implementations where a different data connection exists between the vaporizer device 100 and the point-of-sale device 810 (and/or the dock 815), the flexible substrate 1008 may include a different type of connector than the universal serial bus (USB) connector 1004. Moreover, the flexible substrate 1008 may include any number of electrical contacts 1006 for forming the data connection between the vaporizer device 100 and the point-of-sale device 810 (and/or the dock 815).

The universal serial bus adapter 1020 may be coupled to a carton 1050 configured to hold the vaporizer device 100 (coupled with the charger dock 920) by an adhesive 1014 (e.g., a pressure sensitive adhesive (PSA)) disposed, for example, on surface of the flexible substrate 1008 opposite of the one or more contacts 1006. It should be appreciated that the universal serial bus adapter 1020 may provide universal serial bus (USB) connection (e.g., USB-A, USB-B, USB-C, mini-USB, micro-USB, USB 3, and/or the like) from an exterior of the packaging 1000 to the charger dock 920 coupled with the vaporizer device 100 inside the packaging 1000 such that the point-of-sale device 810 and/or the dock 815 may communicate the activation data through the charger dock 920 to the vaporizer device 100 while the vaporizer device 100 remains inside the packaging 1000. Moreover, the universal serial bus connection to the charger dock 920 (and the corresponding communication link to the vaporizer device 100 inside the packaging 1000) may be disconnected by at least removing a pull tab 1002 included with the universal serial bus adapter 1020.

Figure 14A:
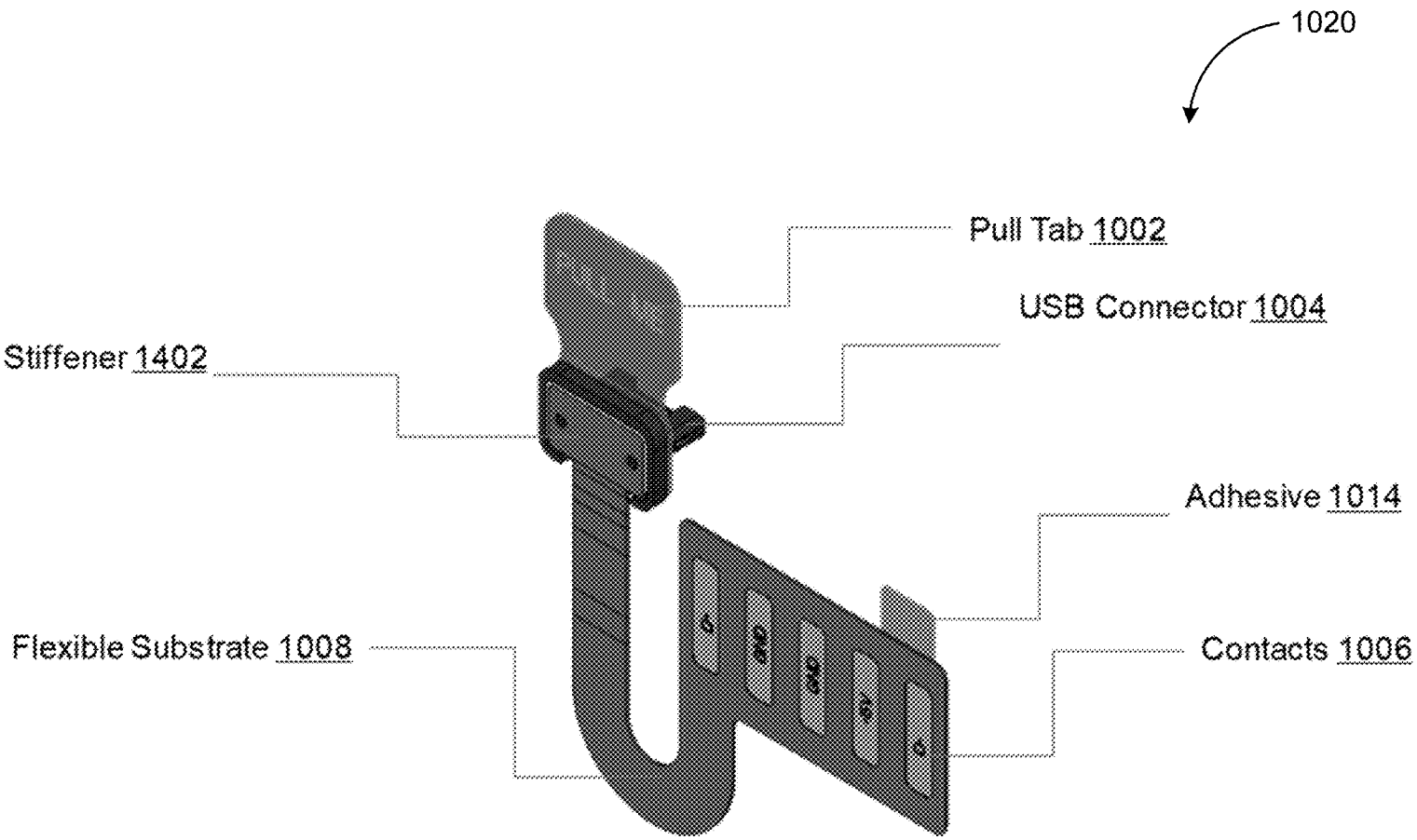
FIG. 14A depicts another example of a universal serial bus (USB) adapter consistent with implementations of the current subject matter.
Figure 14B:
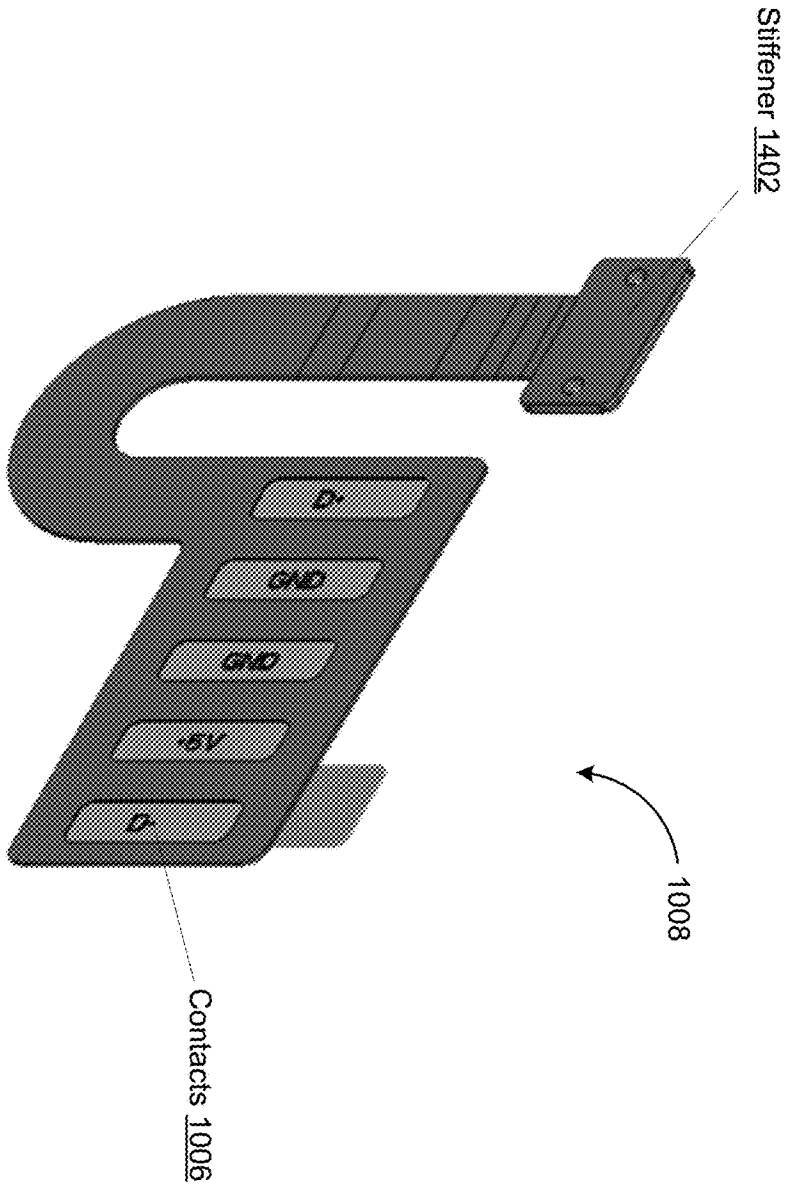
FIG. 14B depicts a perspective view of a front surface of an example of a universal serial bus (USB) adapter consistent with implementations of the current subject matter.
Figure 14C:
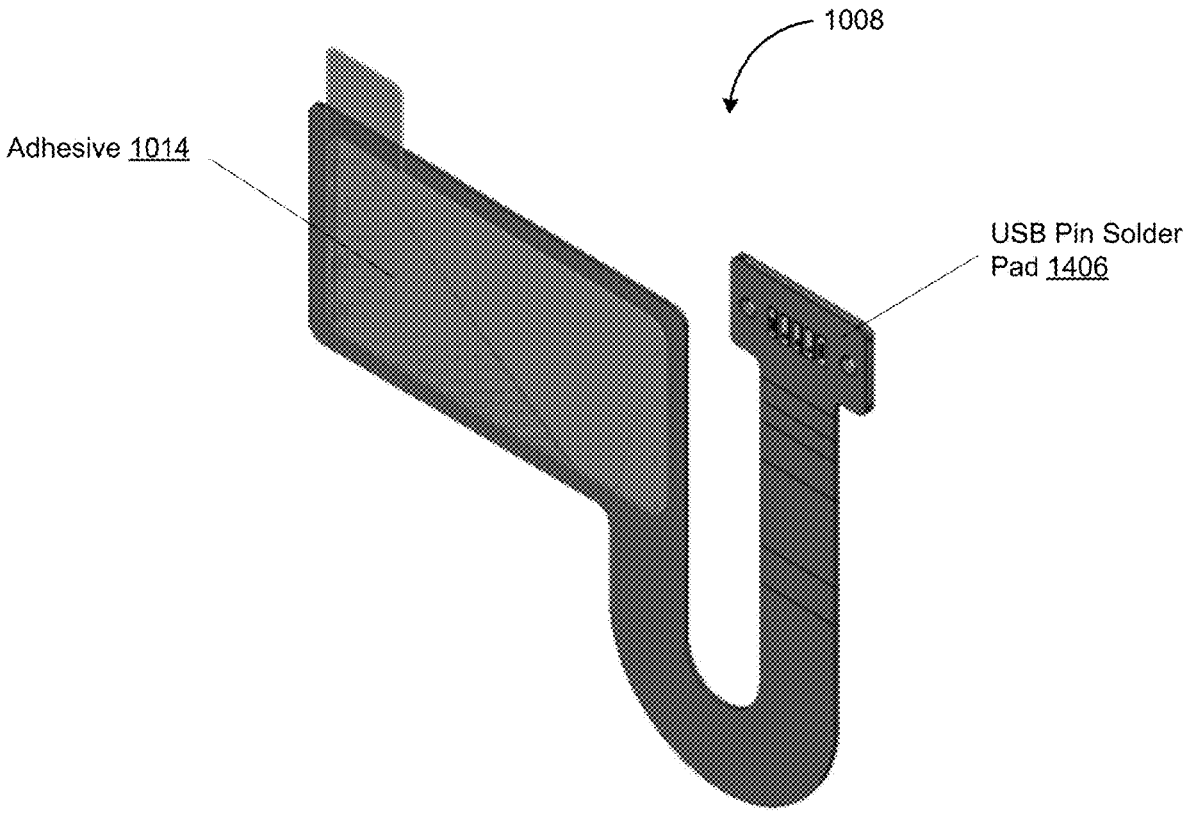
FIG. 14C depicts a perspective view of a back surface of an example of a universal serial bus (USB) adapter consistent with implementations of the current subject matter.

FIGS. 14A-C depict another example of the universal serial bus adapter 1020 that may be integrated into the packaging 1000 consistent with implementations of the current subject matter. The example of the universal serial bus adaptor 1020 shown in FIGS. 14A-C may include the flexible substrate 1008 coupled with the universal serial bus connector 1004, whose connection to the vaporizer device 100 inside the packaging 100 may be disconnected by at least removing the pull tab 1002. The one or more contacts 1006 may be disposed on one surface of the flexible substrate 1008 while the adhesive 1014 (e.g., a pressure sensitive adhesive (PSA) and/or the like) may be disposed on an opposite surface of the flexible substrate 1008. Moreover, in the example of the universal serial bus adapter 1020 shown in FIG. 14A, the flexible substrate 1008 may include a stiffener 1402 configured to reinforce and increase a structural integrity of at least a portion of the flexible substrate 1008. Examples of the stiffener 1402 include glass-reinforced epoxy laminate (e.g. FR4 and/or the like), polyimide (PI) and stainless steel.

Figure 14D:
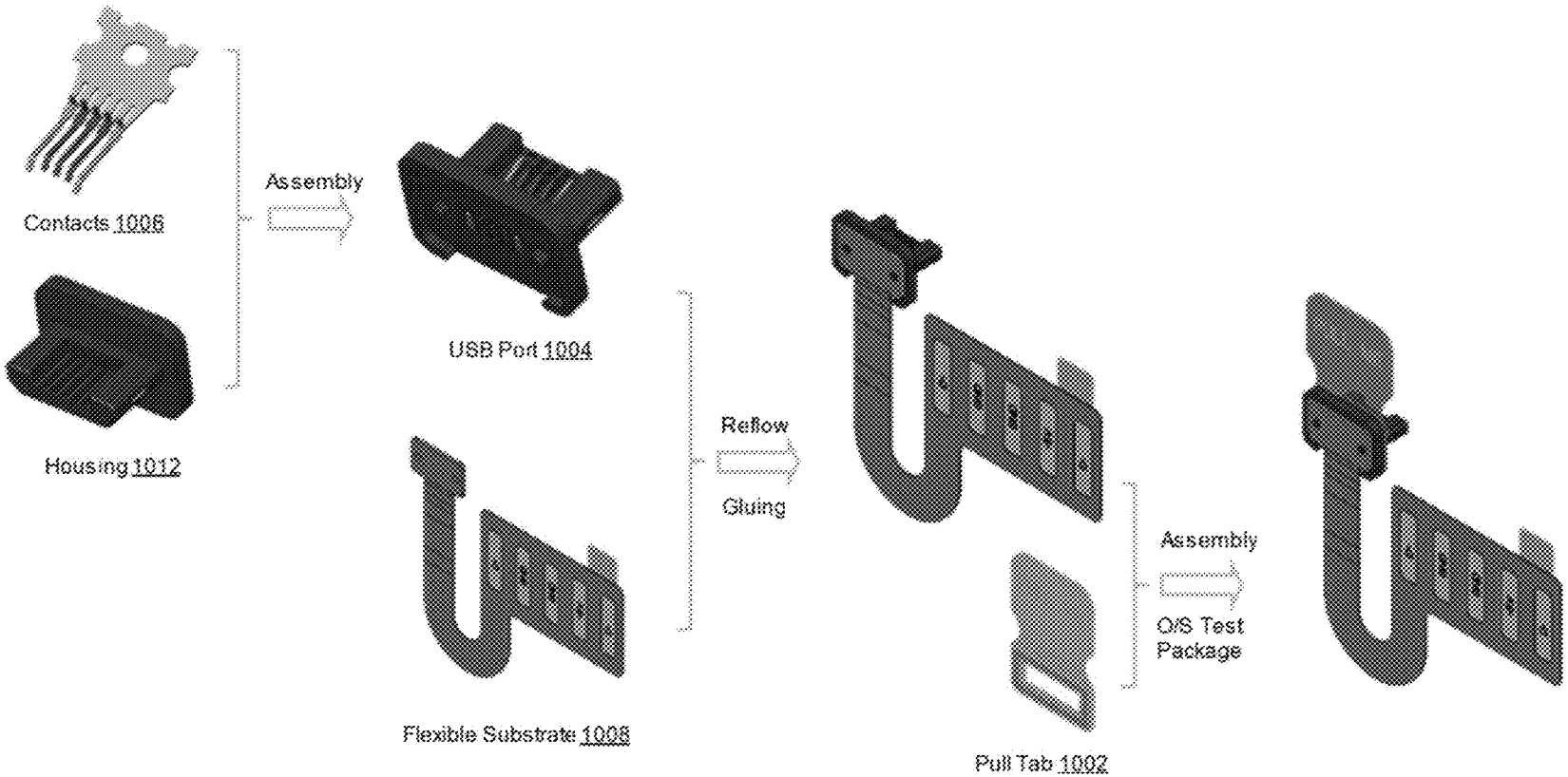
FIG. 14D depicts an example of a process for assembling a universal serial bus (USB) adapter consistent with implementations of the current subject matter.
Figure 14E:
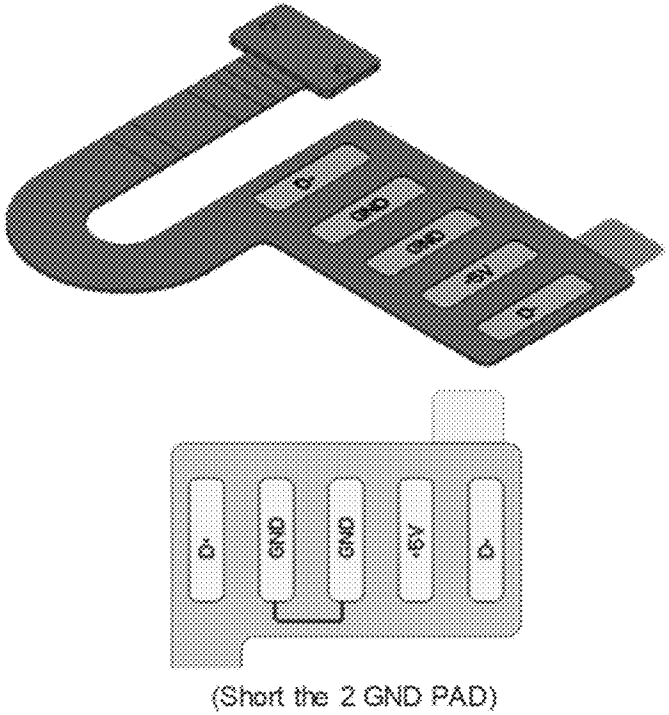
FIG. 14E depicts an example of electrical connections in a universal serial bus (USB) adapter consistent with implementations of the current subject matter.
Figure 14E:
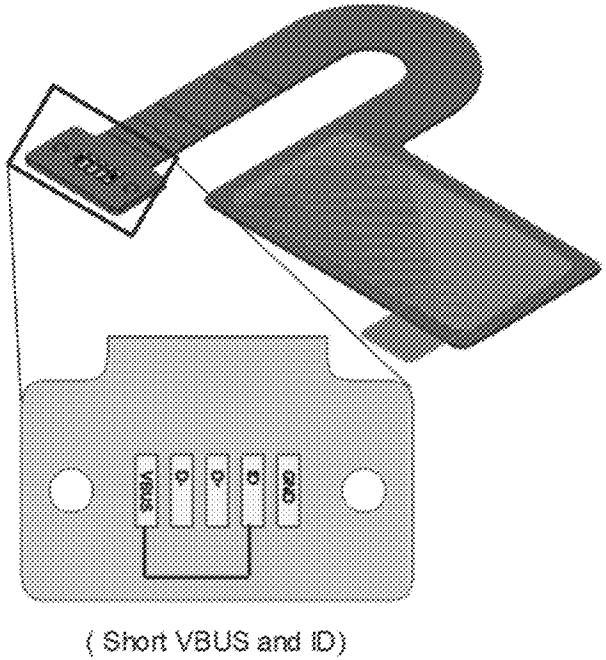

In some implementations of the current subject matter, the universal serial bus adapter 1020 may be formed by assembling the pull tab 1002, the universal serial port 1004, the one or more contacts 1006, and the housing 1012 containing the universal serial bus (USB) connector 1004 in the manner shown in FIG. 14D. Moreover, FIG. 14E shows that a short electrical circuit may be formed between a pair of the contacts 1006 such that the presence of the packaging 1000, when the packaging 1000 is inserted into the dock 815, may be detected based on the signal across the shorted contacts 1006.

Figure 13A:
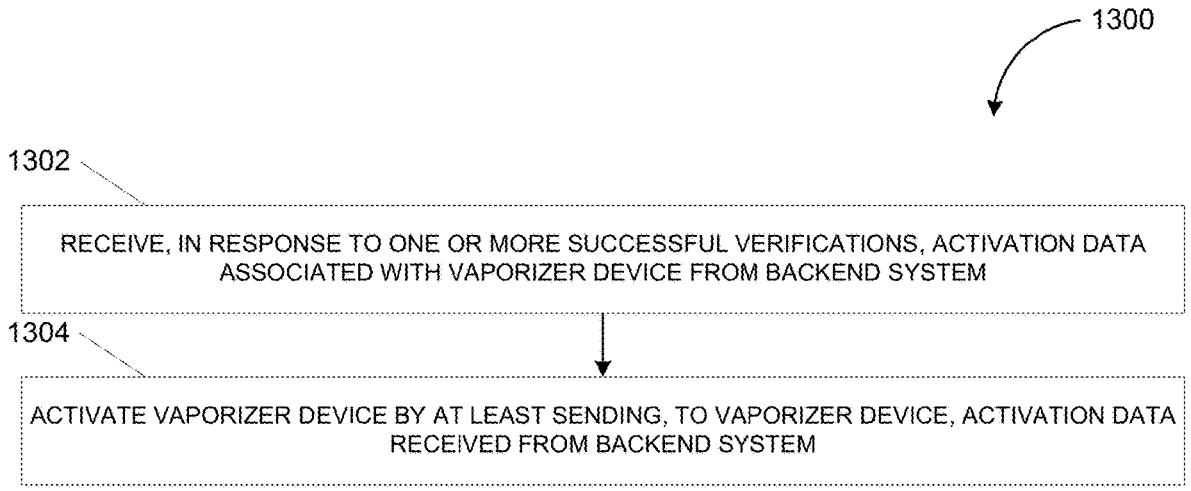
FIG. 13A depicts a flowchart illustrating a process for activating a vaporizer device consistent with implementations of the current subject matter.

FIG. 13A depicts a flowchart illustrating an example of a process 1300 for activating the vaporizer device 100 consistent with implementations of the current subject matter. Referring to FIG. 13A, the process 1300 may be performed by the point-of-sale device 810 in order to activate the vaporizer device 100. The point-of-sale device 810 may, in response to one or more successful verifications, receive, from the backend system 830, activation data (e.g., an activation code) associated with the vaporizer device 100 (1302). The activation of the vaporizer device 100 may be contingent upon of the vaporizer device 100 may be contingent upon one or more successful verifications (e.g., an identity verification, a purchase limit verification, and/or the like), at least some of which may be performed by the point-of-sale device 810. Upon the one or more successful verifications, the point-of-sale device 810 may receive, based at least on an identifier associated with the vaporizer device 100 (e.g., a serial number and/or the like), activation data (e.g., an activation code) associated with the vaporizer device 100 from the backend system 830. The point-of-sale device 810 may activate the vaporizer device by at least sending, to the vaporizer device 100, the activation data received from the backend system 830 (1304). For instance, the point-of-sale device 810 may send the activation data to the vaporizer device 100 directly or via the dock 815 coupled with the point-of-sale device 810. The vaporizer device 100 may be disposed in a packaging having one or more contacts that are coupled to the charging contacts 128 of the vaporizer device 100 such that the activation data may be communicated to the vaporizer device 100 while the vaporizer device 100 remains in its packaging.

As noted, activation of the vaporizer device 100 may further include communicating, to the vaporizer device 100, the activation data received from the backend system 830. Instead of the point-of-sale device 810 and/or the dock 815 communicating the activation data to the vaporizer device 100, the computing device 820 associated with the user of the vaporizer device 100 may communicate the activation data to the vaporizer device 100. For example, subsequent to receiving the activation data from the backend system 830, the point-of-sale device 810 may send the activation data to the computing device 820, for example, via the network 840 in a short messaging service (SMS) message, an email, and/or the like. Alternatively, the activation data may be input into and/or retrieved by the computing device 820 based on an output from the point-of-sale device 810 that includes, for example, the activation data, a representation (e.g., a barcode and/or the like) of the activation data, a link (e.g., a hyperlink) to the activation data, and/or the like.

Figure 12:
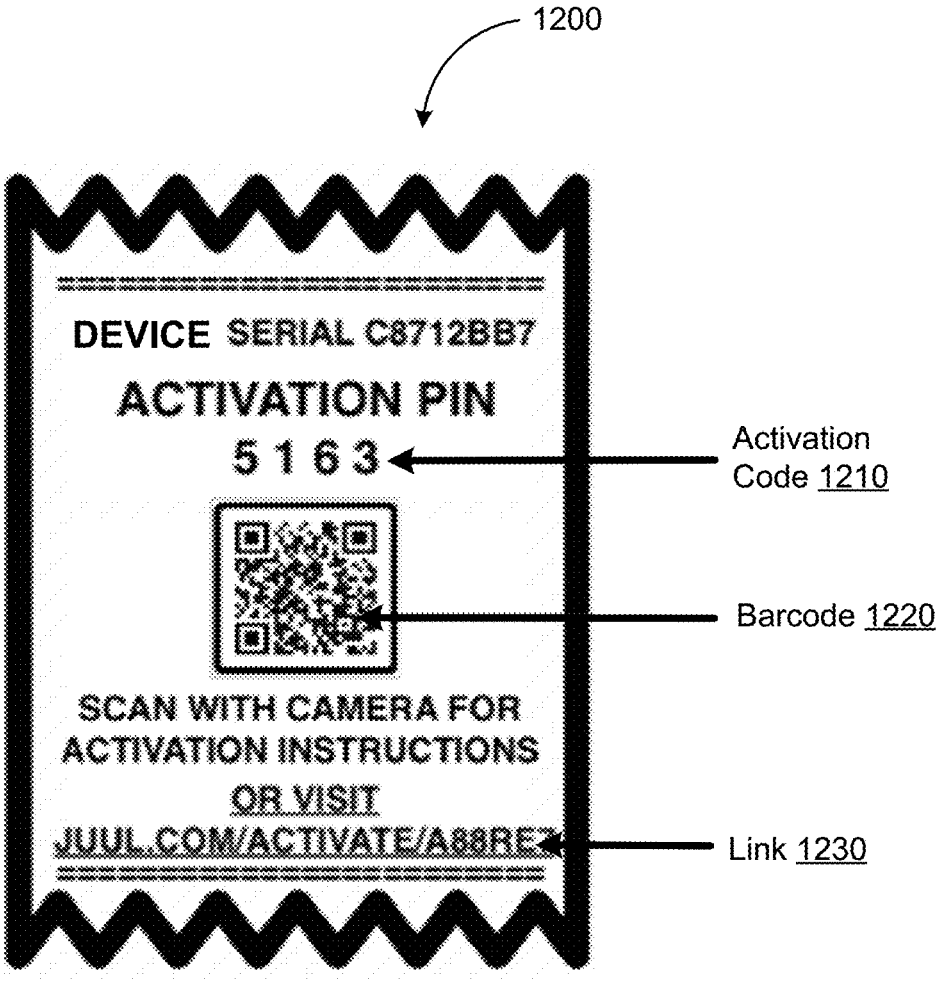
FIG. 12 depicts an example of an output generated by a point-of-sale terminal consistent with implementations of the current subject matter.

To further illustrate, FIG. 12 depicts an example of an output 1200 generated by the point-of-sale device 810 consistent with implementations of the current subject matter. The computing device 820 may determine and/or access, based at least on the output 1200 from the point-of-sale device 810, the activation data for activating the vaporizer device 100. For example, as shown in FIG. 12, the output 1200 generated by the point-of-sale device 810 may include an activation code 1210 associated with the vaporizer device 100, which may be input into the computing device 820. Alternatively and/or additionally, the output 1200 from the point-of-sale device 810 may include a barcode 1220 (e.g., a Quick Response (QR) code or another two-dimensional barcode) and/or a link 1230 for the computing device 820 to access, for example, at the backend system 830, the activation data associated with the vaporizer device 100. According to some implementations of the current subject matter, the computing device 820 may communicate, to the vaporizer device 100, the activation data in order to transition the vaporizer device 100 from an inactive state in which the vaporizer device 100 is unable to vaporize the vaporizable material 102 to an active state in which the vaporizer device 100 is able to vaporize the vaporizable material 102.

Figure 13B:
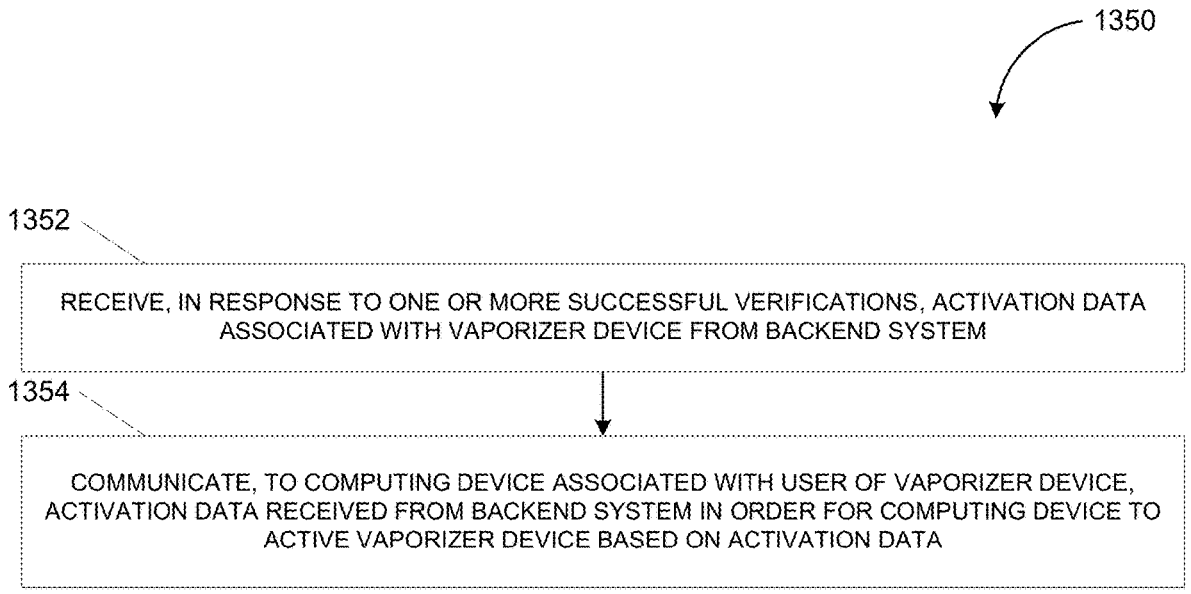
FIG. 13B depicts a flowchart illustrating a process for activating a vaporizer device consistent with implementations of the current subject matter.

FIG. 13B depicts a flowchart illustrating another example of a process 1350 for activating the vaporizer device 100 consistent with implementations of the current subject matter. The point-of-sale device 810 may, in response to one or more successful verifications, receive, from the backend system 830, activation data (e.g., an activation code) associated with the vaporizer device 100 (1352). As noted, the activation of the vaporizer device 100 may be contingent upon of the vaporizer device 100 may be contingent upon one or more successful verifications (e.g., an identity verification, a purchase limit verification, and/or the like), at least some of which may be performed by the point-of-sale device 810. Upon the one or more successful verifications, the point-of-sale device 810 may receive, based at least on an identifier associated with the vaporizer device 100 (e.g., a serial number and/or the like), activation data (e.g., an activation code) associated with the vaporizer device 100 from the backend system 830.

The point-of-sale device 810 may communicate, to the computing device 820 associated with a user of the vaporizer device 100, the activation data received from the backend system 830 in order for the computing device 820 to activate the vaporizer device 100 based on the activation data (1354). For instance, the point-of-sale device 810 may communicate the activation data for the vaporizer device 100 by at least generating an output that includes for example, the activation data, a representation (e.g., a barcode and/or the like) of the activation data, a link (e.g., a hyperlink) to the activation data, and/or the like. The computing device 820 may determine and/or retrieve, based at least on the output of the point-of-sale device 810, the activation data. Moreover, the computing device 820 may communicate the activation data to the vaporizer device 100 in order to transition the vaporizer device from an inactive state in which the vaporizer device 100 is incapable of vaporizing the vaporizable material 1302 to an active state in which the vaporizer device 100 is capable of vaporizing the vaporizable material 1302.

The computing device 820 may be configured to communicate the activation data to the vaporizer device 100. For example, the computing device 820 and the vaporizer device 100 may communicate the activation data to the vaporizer device 100 via a native application associated with the vaporizer device 100. The native application may be downloaded and installed at the computing device 820 and may require the activation data to be communicated to the vaporizer device 100 using hardware that are only accessible to the native application such as, for example, Bluetooth Low Energy (BLE), near field communication (NFC), and/or the like. However, a native application associated with the vaporizer device 100 may not be available, in which case various implementations of the current subject matter enable communication between the vaporizer device 100 and the computing device 820 in the absence of a native application associated with the vaporizer device 100. For example, the vaporizer device 100 and the computing device 820 may be configured to communicate via a web application that may be accessed through a web browser at the computing device 820 but does not require being downloaded and/or installed at the computing device 820. Furthermore, the exchange of data between the vaporizer device 100 and the computing device 820 may be performed using hardware at the computing device 820 that is accessible to the web browser including, for example, screen, camera, speakers, microphone, and/or the like.

In some implementations of the current subject matter, the vaporizer device 100 and the computing device 820 may engage in two-way communication using audio signals. Accordingly, the vaporizer device 100 and/or the computing device 820 may include hardware for audio communication such as, for example, a microphone, a speaker, and/or the like. Alternatively and/or additionally, the vaporizer device 100 and/or the computing device 820 may be coupled to an apparatus that includes hardware for audio communication. One example of an apparatus that includes hardware for audio communication may be a dock (e.g., a universal serial bus (USB) charging dock and/or the like) that couples with the vaporizer device 100 and/or the computing device 820. Other examples of apparatuses that include hardware for audio communication may include the vaporizer cartridge 120 or an apparatus that couples to the vaporizer device 100 in a same and/or similar manner as the vaporizer cartridge 120.

Alternatively and/or additionally, the vaporizer device 100 and the computing device 820 may engage in two-way communication using optical signals. The vaporizer device 100 and/or the computing device 820 may therefore include hardware for optical communication including as, for example, an optical transmitter (e.g., light emitting diodes (LEDs)), an optical receiver (e.g., camera), and/or the like. Alternatively and/or additionally, the vaporizer device 100 and/or the computing device 820 may be coupled to an apparatus that includes hardware for optical communication. One example of an apparatus that includes hardware for optical communication may be a dock (e.g., a universal serial bus (USB) charging dock and/or the like) that couples with the vaporizer device 100 and/or the computing device 820. Other examples of apparatuses that include hardware for optical communication may include the vaporizer cartridge 120 or an apparatus that couples to the vaporizer device 100 in a same and/or similar manner as the vaporizer cartridge 120.

FIGS. 2A-D depicts an example of an apparatus 200 consistent with implementations of the current subject matter. In the example shown in FIGS. 2A-D, the apparatus 200 may be a dock. As shown in FIGS. 2A-D, the apparatus 200 may include a first interface 205*a* for coupling with the vaporizer device 100 and a second interface 205*b* for coupling with an external power source which may, in some instances, be the computing device. For instance, in the example shown in FIGS. 2A-D, the first interface 205*a* may include one or more charging contacts 261 configured mate with the charging contacts 128 of the vaporizer device 100 while the second interface 205*b* may include a universal serial bus (USB) plug configured to mate with a universal serial bus receptacle at the computing device 820. When coupled in this manner, the computing device 820 may serve as an external power source that charges the vaporizer device 100 (e.g., the power source 112) via the apparatus 200.

Figure 2A:
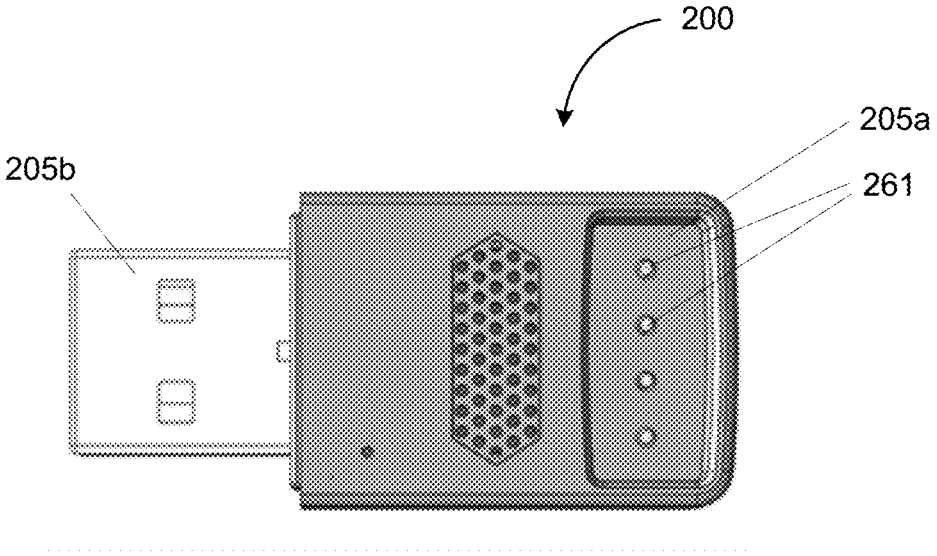
FIG. 2A depicts a top view of an example of an apparatus consistent with implementations of the current subject matter.
Figure 2B:
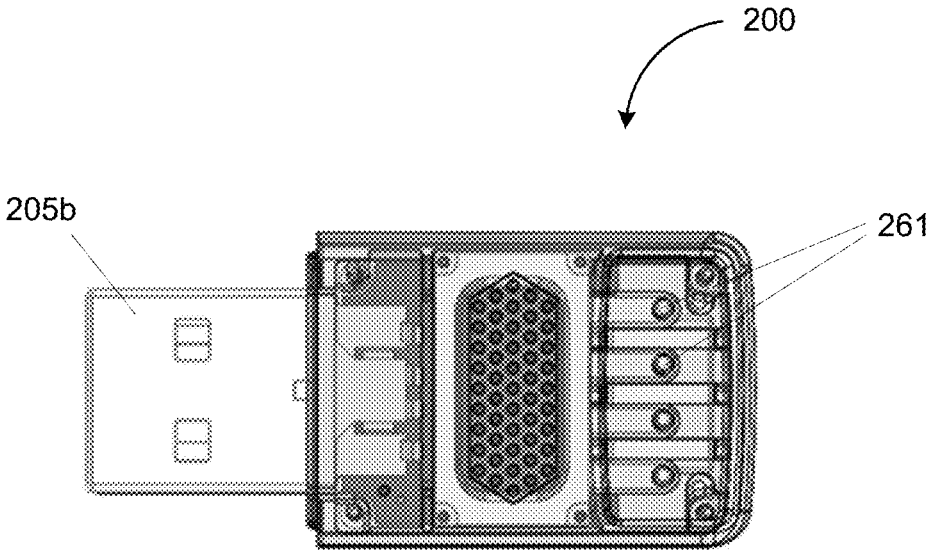
FIG. 2B depicts a top transparent view of an example of an apparatus consistent with implementations of the current subject matter.
Figure 2C:
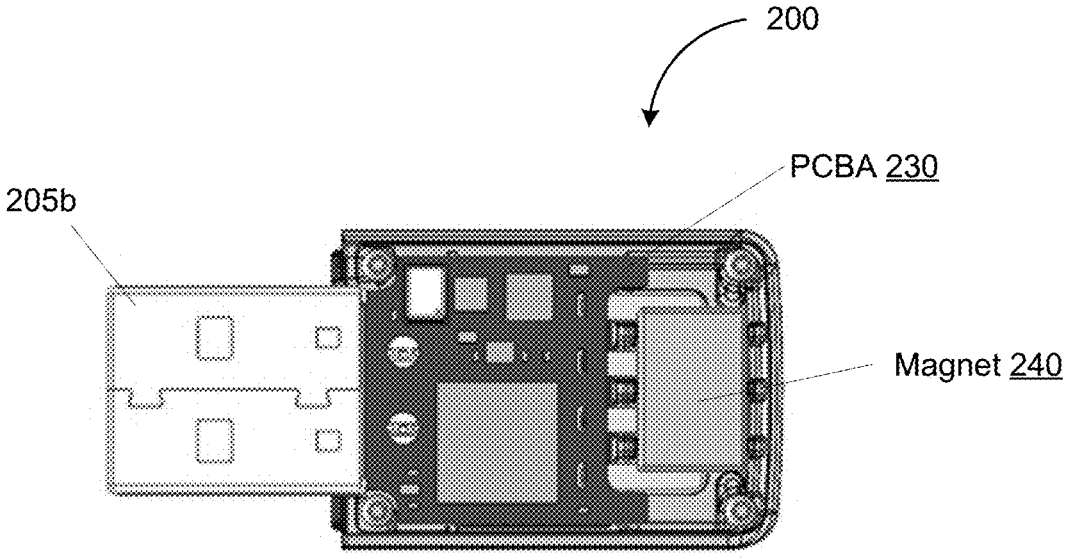
FIG. 2C depicts a bottom transparent view of an example of an apparatus consistent with implementations of the current subject matter.
Figure 3:
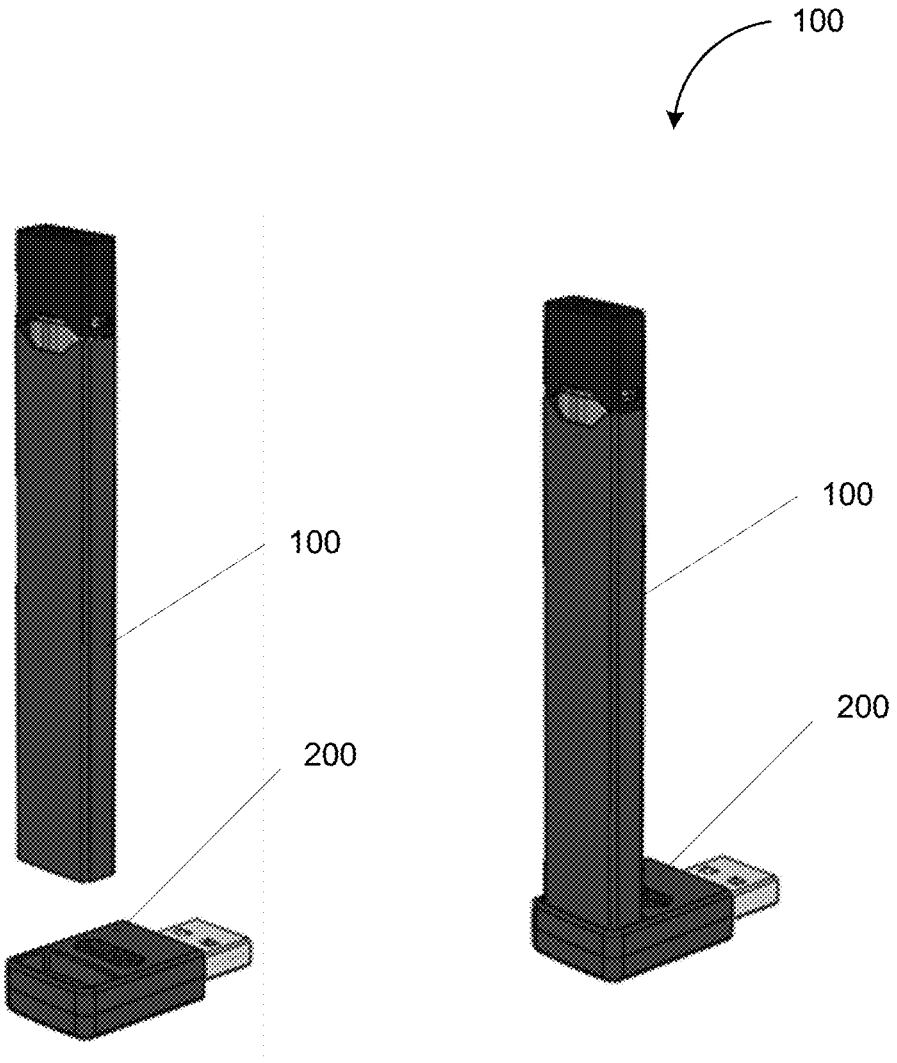
FIG. 3 depicts a side perspective view of a coupling between a vaporizer device and an example of an apparatus consistent with implementations of the current subject matter.

As shown in FIG. 2A, the apparatus 200 may include one or more features for supporting and/or retaining the vaporizer device 100 while the vaporizer device 100 is coupled with the apparatus 200. For instance, the first interface 205 may include one or more chamber walls configured to provide coupling support between the vaporizer device 100 and apparatus 200 as well as assist in retaining the vaporizer device 100 in the first interface 205*a* of the charging body 252. Alternatively and/or additionally, the first interface 205 may include a magnet 240 configured to provide a magnetic force for securing the vaporizer device 100 to the apparatus 200. To further illustrate, FIG. 3 depicts a side perspective view of a coupling between the vaporizer device 100 and an example of the apparatus 200 consistent with implementations of the current subject matter.

Figure 2D:
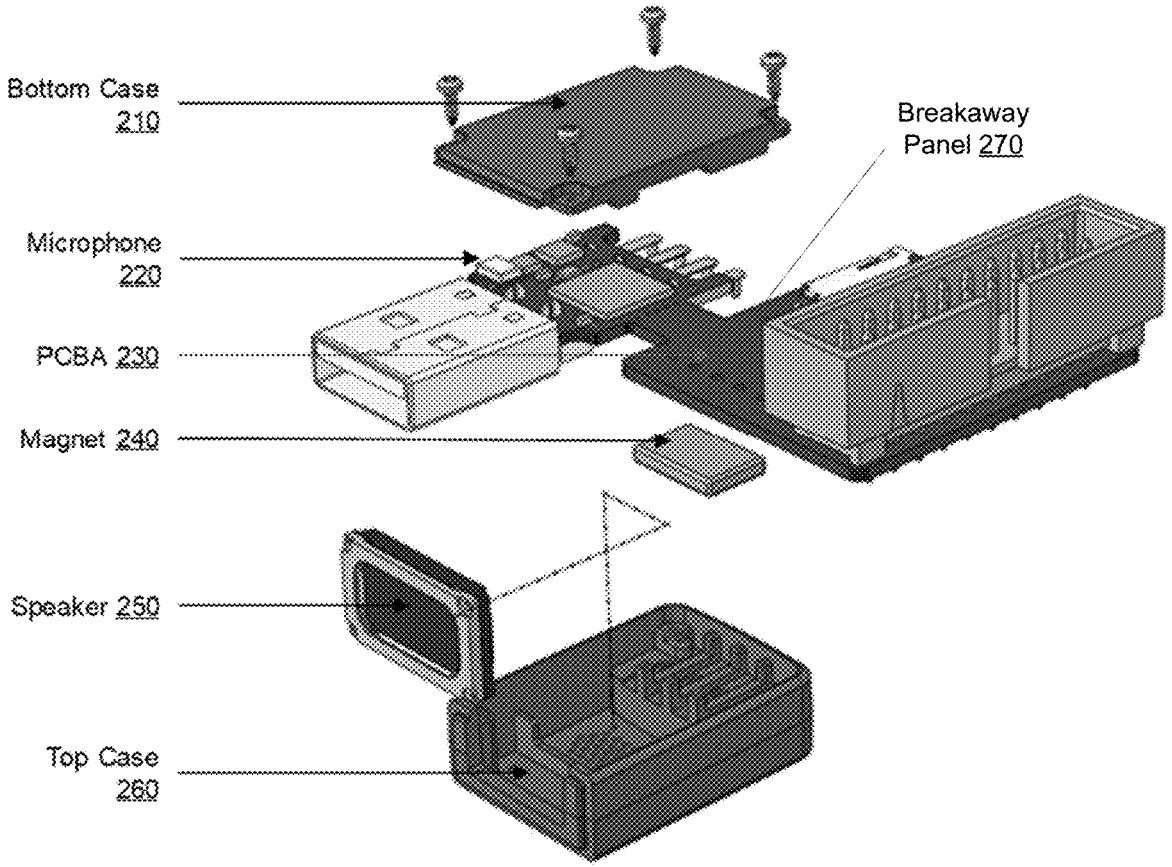
FIG. 2D depicts an exploded view of an example of an apparatus consistent with implementations of the current subject matter.

As noted, the vaporizer device 100 and the computing device 820 may engage in two-way communication using audio signals. Moreover, the hardware for audio communication between the vaporizer device 100 and the computing device may be included in the apparatus 200. For example, FIG. 2D depicts an exploded view of an example of the apparatus 200 configured to enable audio communication between the vaporizer device 100 and the computing device 820. As shown in FIG. 2D, the apparatus 200 may include a bottom case 210, a microphone 220 that is disposed on a printed circuit board assembly (PCBA) 230, the magnet 240, a speaker 250, and a top case 260. In the example shown in FIG. 2D, the printed circuit board assembly 230 may be coupled to a breakaway panel 270 including one or more components for debugging the printed circuit board assembly 230 including, for example, a secure digital (SD) card, debug interfaces (e.g., joint test action group (JTAG), serial port), test points, indicator light emitting diodes (LEDs), and/or the like. To further illustrate, FIG. 4B depicts a top view of an example of the printed circuit board assembly 230 while FIG. 4C depicts a bottom view of an example of the printed circuit board assembly 230.

Figure 4A:
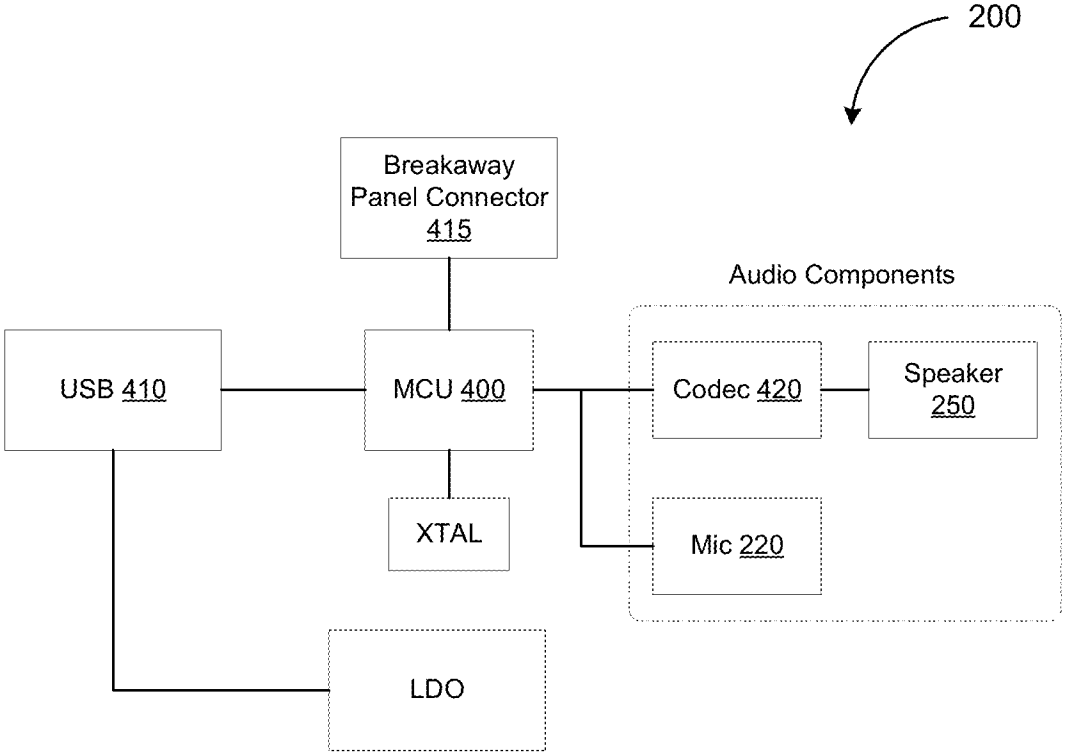
FIG. 4A depicts a block diagram illustrating an example of an apparatus consistent with implementations of the current subject matter.
Figure 4B:
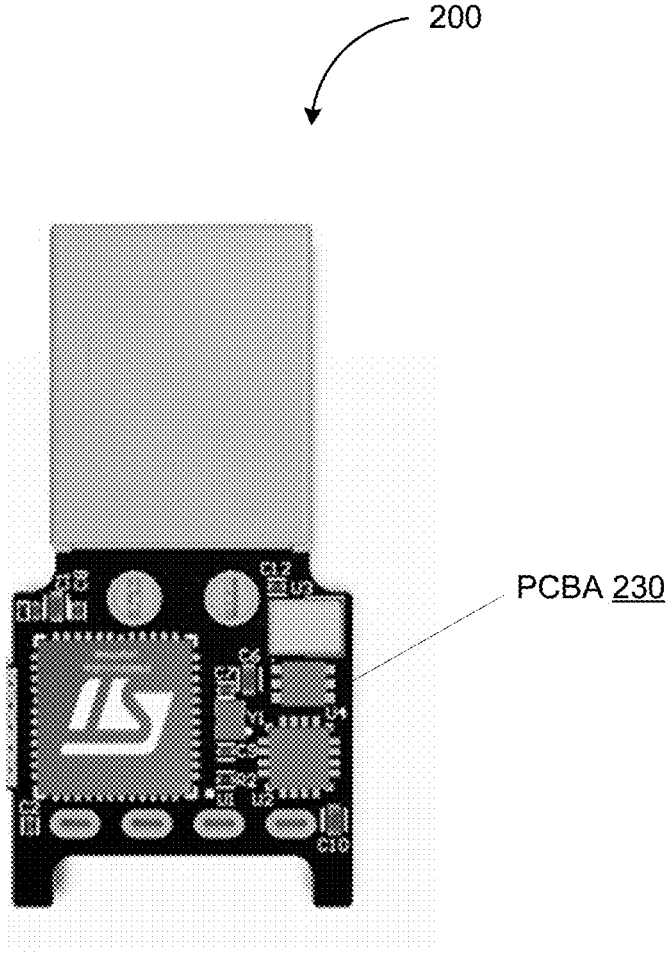
FIG. 4B depicts a top view of a printed circuit board implementing an example of an apparatus consistent with implementations of the current subject matter.
Figure 4C:
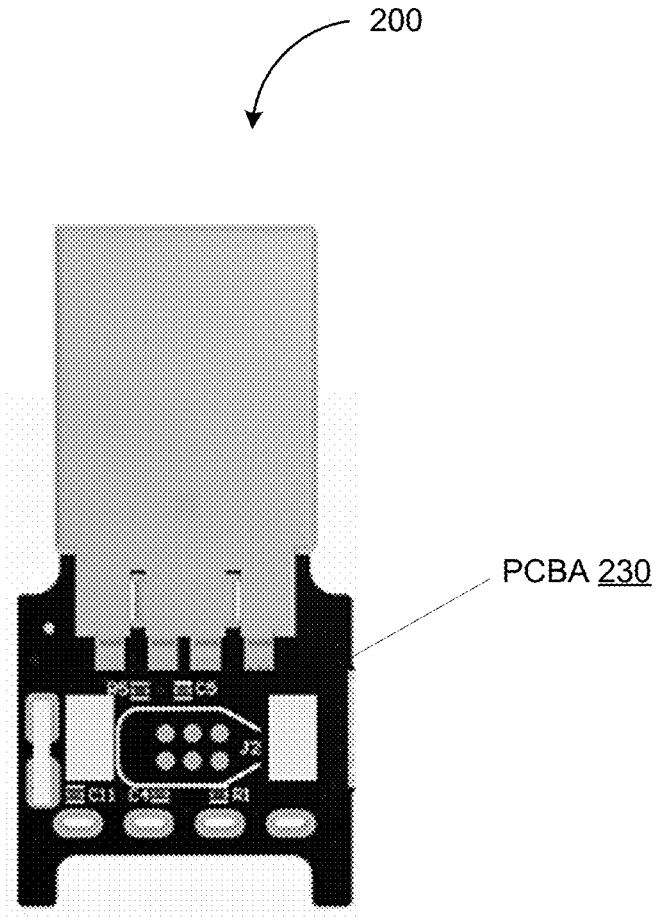
FIG. 4C depicts a bottom view of a printed circuit board implementing an example of an apparatus consistent with implementations of the current subject matter.

FIG. 4A depicts a block diagram illustrating an example of the apparatus 200 consistent with implementations of the current subject matter. Referring to FIG. 4A, the apparatus 200 may include, for example, as part of the printed circuit board assembly, a microcontroller (MCU) 400. The microcontroller 400 may be coupled to a universal serial bus (USB) 410 (e.g., the second interface 205*b*), a connector 415 to the breakaway panel 270 including the one or more debugging components, and the audio components for enabling audio-based communication between the vaporizer device 100 and the computing device 820 coupled to the apparatus 200. As shown in FIG. 4A, in addition to the microphone 220 and the speaker 250, the audio components for enabling audio-based communication between the vaporizer device 100 and the computing device 820 coupled to the apparatus 200 may include a codec 420.

In some implementations of the current subject matter, the speaker 250 may be used to send one or more audio signals from the vaporizer device 100 to the computing device and/or from the computing device 820 to the vaporizer device 100. The microphone 220 may be used to detect one or more audio signals sent from the vaporizer device 100 to the computing device 820 and/or sent from the computing device 820 to the vaporizer device 100. Furthermore, the codec 420 may be configured to encode and/or decode the one or more audio signals exchanged between the vaporizer device 100 and the computing device 820. For instance, the data (e.g., activation data, usage data, and/or the like) that is exchanged between the vaporizer device 100 and the computing device 820 may be encoded, by the codec 420, as audio signals using a variety of techniques including, for example, spread spectrum frequency shift keying (FSK), forward error correction, and/or the like. Alternatively and/or additionally, the codec 420 may decode audio signals corresponding to the data exchanged between the vaporizer device 100 and the computing device 820. As noted, prior to being decoded by the codec, the audio signals may be preprocessed to minimize background noise including, for example, by applying broad-band filtering, noise cancellation, blind source separation, and/or the like.

In implementations where the vaporizer device 100 and the computing device 820 engage in two-way optical communication, the apparatus 200 may be configured to include the corresponding hardware including, for example, an optical transmitter (e.g., light emitting diodes (LEDs)), an optical receiver (e.g., camera), and/or the like. By including the hardware for audio and/or optical communication in the apparatus 200 instead of the vaporizer device 100 and/or the computing device 820 may enable the vaporizer device 100 and the computing device 820 to engage in audio and/or optical based communication without imposing the cost and complexity of the corresponding hardware on the vaporizer device 100 and/or the computing device 820.

Figure 5A:
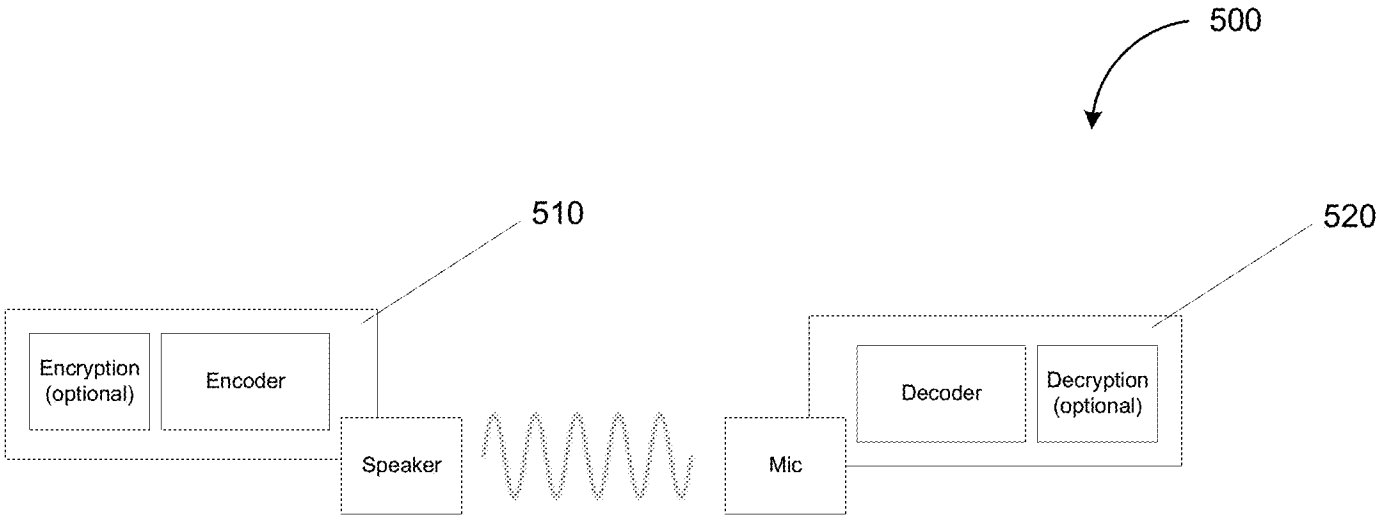
FIG. 5A depicts an example of a communication system consistent with implementations of the current subject matter.

FIG. 5A depicts an example of a communication system 500 consistent with implementations of the current subject matter. In the example of the communication system 500 shown in FIG. 5A, a first device 510 may send, to a second device 520, a first signal including by outputting the first audio signal using a speaker included and/or coupled with the first device 510. Meanwhile, the second device 520 may receive, from the first device 510, the first audio signal including by detecting the first audio signal using a microphone included and/or coupled with the second device 520. Alternatively and/or additionally, the second device 520 may also send, to the first device 510, a second audio signal including by outputting the second audio signal using a speaker included and/or coupled with the second device 520. The first device 510 may include and/or be coupled with a microphone that enables the first device 510 to detect the second audio signal output by the second device 520.

In some implementations of the current subject matter, the transmission link (e.g., audio link, optical link, and/or the like) between the first device 510 and the second device 520 may be secured using a variety of techniques including, for example, session based ephemeral keys. The data that is exchanged between the first device 510 and the second device 520 may be encrypted using a symmetric encryption technique or asymmetric encryption technique including, for example, advanced encryption standard (AES) cryptography, elliptic curve cryptography (EEC), Rivest-Shamir-Adleman (RSA) cryptography, and/or the like.

Meanwhile, the keys used for encrypting the data exchanged between the first device 510 and the second device 520 may be established using a variety of secure exchange techniques including, for example, Diffie-Hellman and/or the like.

In some implementations of the current subject matter, the vaporizer device 100 and the computing device 820 may engage in two-way audio communication in the manner shown in FIG. 5A. For example, the vaporizer device 100 may send, to the computing device 820, a first audio signal corresponding to activation data, usage data, and/or the like. Likewise, the computing device 820 may send, to the vaporizer device 100, a second audio signal corresponding to activation data, usage data, and/or the like. At least a portion of the hardware that enables the vaporizer device 100 and the computing device 820 to send and receive the first audio signal and the second audio signal may be included at each of the vaporizer device 100 and the computing device 820. Alternatively and/or additionally, as shown in FIGS. 2A-D and 4A-D, at least a portion of the hardware that enables the vaporizer device 100 and the computing device 820 to exchange audio signals may also be included in the apparatus 200 coupled with the vaporizer device 100 and/or the computing device 820. Accordingly, it should be appreciated that the communication system 500 may include an intermediary such as, for example, the apparatus 200, configured to send and/or receive the first audio signal and/or the second audio signal.

In some implementations of the current subject matter, the vaporizer device 100 and the computing device 820 may engage in audio communication (and/or optical communication) in the absence of a native application associated with the vaporizer device 100. However, a native application associated with the vaporizer device 100 may not always be available because the accessibility of the native application may be contingent on being downloaded and installed directly on the computing device 820. As such, instead of a native application, the vaporizer device 100 and the computing device 820 may be configured to communicate via a web application that may be accessed through a web browser at the computing device 820 instead of being downloaded and/or installed at the computing device 820. Moreover, instead of hardware that are only accessible to a native application (e.g., Bluetooth, near field communication (NFC), and/or the like), audio (and/or optical) communication between the vaporizer device 100 and the computing device 820 may be performed using hardware at the computing device 820 that is accessible to the web browser including, for example, screen, camera, speakers, microphone, and/or the like.

Figure 5B:
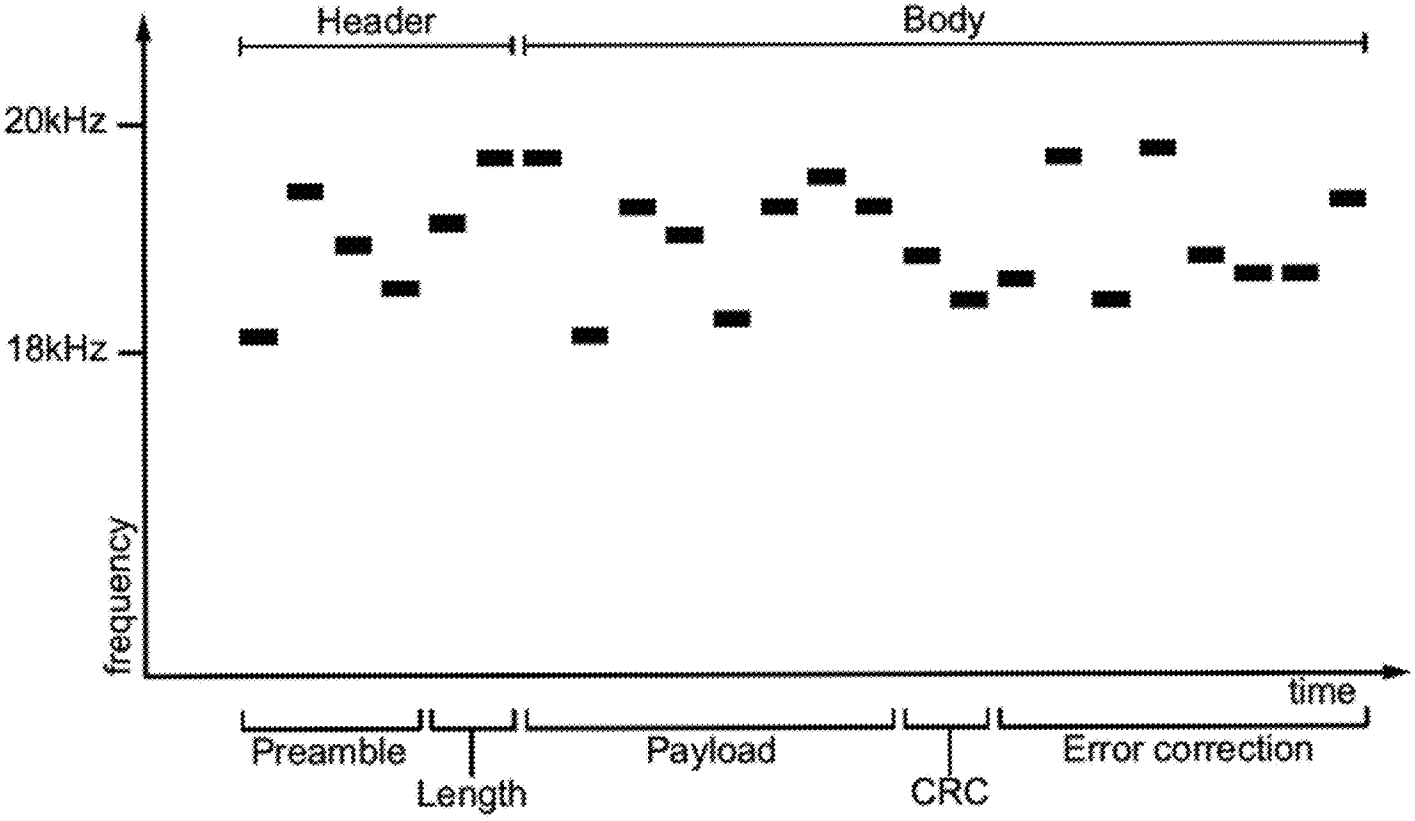
FIG. 5B depicts a format of an example of an audio packet consistent with implementations of the current subject matter.

FIGS. 5B-C depicts the format of various examples of data packets consistent with implementations of the current subject matter. Referring to FIGS. 5A-B, the audio signal that is exchanged between the vaporizer device 100 and the computing device 820 may include one or more audio packets. Each audio packet may include data that has been encoded as various frequencies in the human audible spectrum (e.g., <17 kilohertz) and/or outside of the human audible spectrum (e.g., >20 kilohertz). Moreover, as shown in FIG. 5B, the contents of each audio packet may be associated with a specific format. For instance, in the example shown in FIG. 5B, a single audio packet may include a header including a preamble and a payload length as well as a body including a payload, a checksum, and an error correction sequence.

As noted, the vaporizer device 100 and the computing device 820 may exchange various data (e.g., activation data, usage data, and/or the like) via the apparatus 200. For example, the apparatus 200 may include at least a portion of the hardware necessary for engaging in audio and/or optical based communication and may therefore serve as an intermediary between the vaporizer device 100 and the computing device 820. Moreover, the computing device 820 may communicate with the vaporizer device 100 via a web application that is accessed through a web browser at the computing device 820 instead of a native application downloaded and installed directly at the computing device 820.

FIG. 5C depicts the format of the various examples of data packets that may be exchanged between the vaporizer device 100 and the computing device 820. It should be appreciated that a same and/or similar format may be applicable to audio packets as well as optical packets. For example, as shown in FIG. 5C, the data packets sent from the apparatus 200 to the web application at the computing device 820 may include an identifier of the vaporizer device 100, an identifier of the apparatus 200, and a session identifier. The data packets sent from the web application at the computing device 820 to the apparatus 200 may include an identifier of the apparatus 200, a message authentication code (e.g., a hash-based message authentication code (HMAC)), and a response. The acknowledgment (ACK) and negative acknowledgement (NAK) data packets sent from the apparatus 200 to the web application at the computing device 820 may include one or more bytes indicative of whether the apparatus 200 successfully received a data packet from the computing device 820.

Figure 6A:
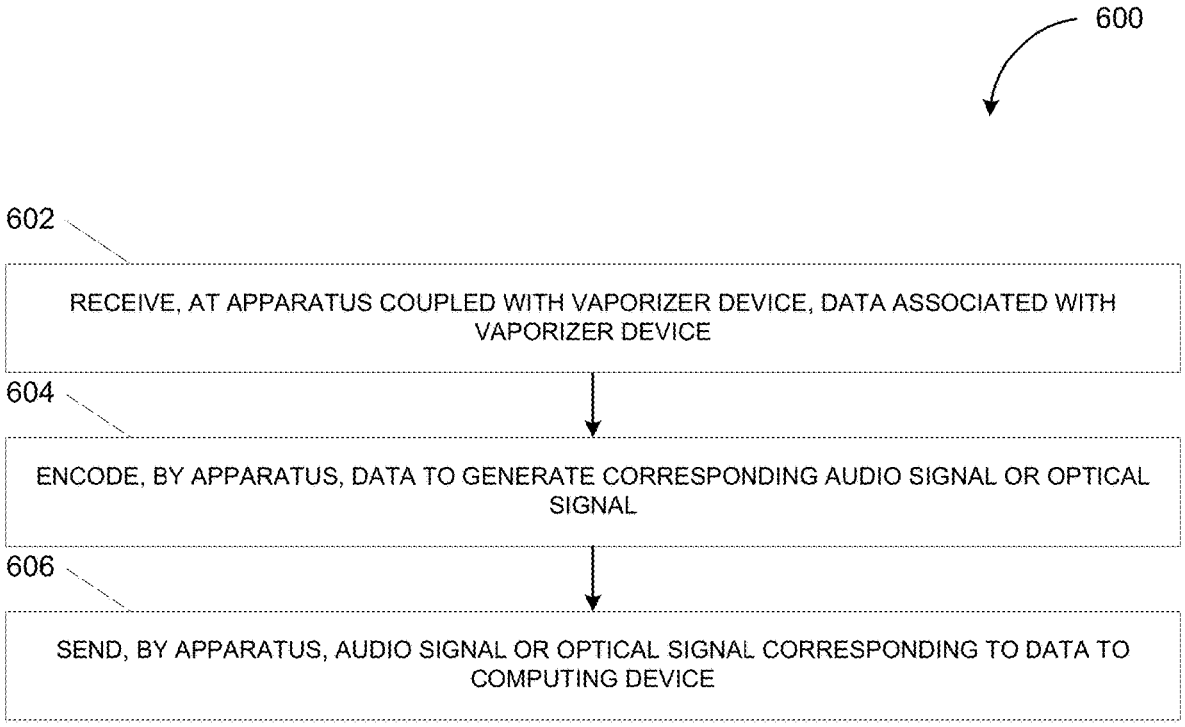
FIG. 6A depicts a flowchart illustrating a process for communicating with a vaporizer device consistent with implementations of the current subject matter.

FIG. 6A depicts a flowchart illustrating a process 600 for communicating with a vaporizer device consistent with implementations of the current subject matter. Referring to FIGS. 1A-C, 2A-D, 3, 4A-D, 5A-C, and 6A, the process 600 may be performed by the apparatus 200 in order to enable an audio (or optical) communication between the vaporizer device 100 and the web application at the computing device 820. However, it should be appreciated that at least a portion of the process 600 may also be performed by the vaporizer device 100 in order to communicate with, for example, a web application at the computing device 820. As shown in FIG. 6A, the apparatus 200 may receive, from the vaporizer device 100, data associated with vaporizer device (602). The apparatus 200 may encode the data to generate a corresponding audio signal or optical signal (604). The apparatus 200 may send, to the computing device 820, the audio signal or the optical signal corresponding to the data (606).

Figure 6B:
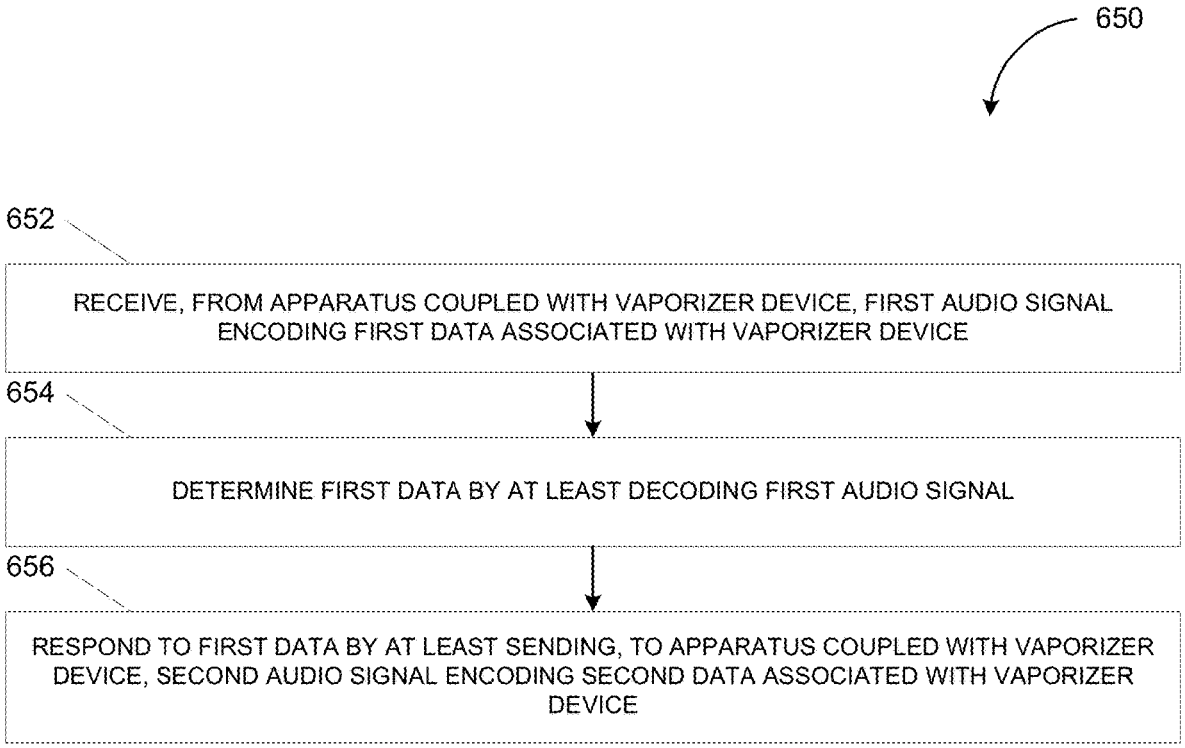
FIG. 6B depicts a flowchart illustrating a process for communicating with a vaporizer device consistent with implementations of the current subject matter.

FIG. 6B depicts a flowchart illustrating a process 650 for communicating with a vaporizer device consistent with implementations of the current subject matter. Referring to FIGS. 1A-C, 2A-D, 3, 4A-D, 5A-C, and 6B, the process 650 may be performed by, for example, a web application at the computing device 820 in order to communicate with the vaporizer device 100. However, it should be appreciated that the process 650 may be performed, at least partially, by the apparatus 200 in order to enable an audio (or optical) communication between the vaporizer device 100 and the web application at the computing device 820. As shown in FIG. 6B, the computing device 820 may receive, from the apparatus 200 coupled with the vaporizer device 100, a first audio signal encoding a first data from the vaporizer device 100 (652). The computing device 820 may determine the first data by at least decoding the first audio signal (654). The computing device 820 respond to the first data by at least sending, to the apparatus 200 coupled with the vaporizer device 100, a second audio encoding a second data associated with the vaporizer device 100 (606).

Figure 7:
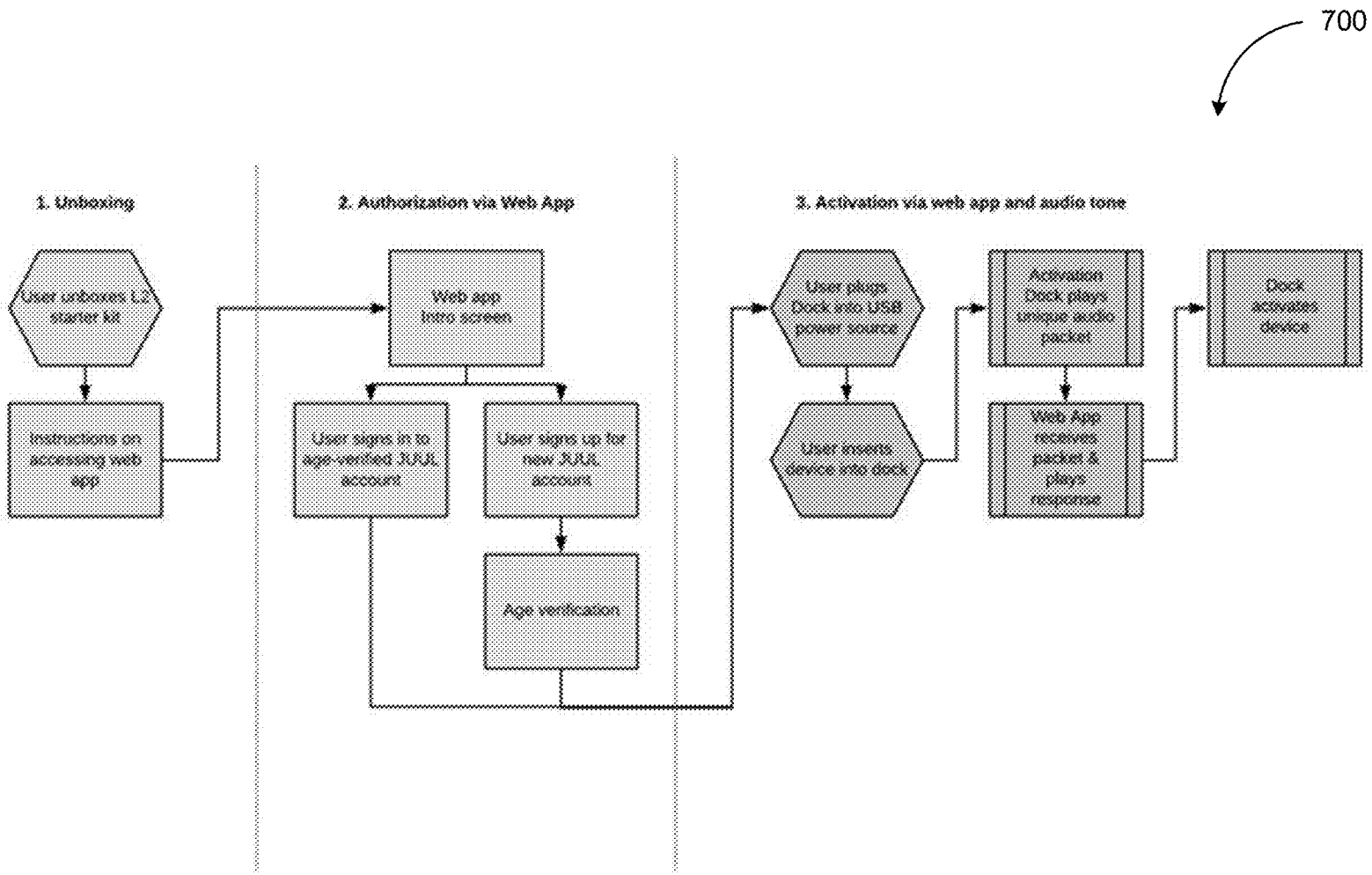
FIG. 7 depicts a flowchart illustrating a process for activating a vaporizer device consistent with implementations of the current subject matter.

FIG. 7 depicts a flowchart illustrating a process 700 for communicating with a vaporizer device consistent with implementations of the current subject matter. Referring to FIGS. 1A-C, 2A-D, 3, 4A-D, 5A-C, and 7, the process 700 may be performed by, for example, a web application at the computing device 820 and the apparatus 200 in order to activate the vaporizer device 100. However, it should be appreciated that the process 700 may be performed by without the apparatus 200 in implementations where the vaporizer device 100 includes the hardware for exchanging audio (or optical) signals.

As shown in FIG. 7, a user may interact with the web application at the computing device 820 in order to perform one or more verifications. In the example shown in FIG. 7, the user may interact with the web application to perform an identity (e.g., age) verification but other forms of verification may be performed by the web application at the computing device 820 including, for example, an authenticity of the cartridge 120 coupled with the vaporizer device 100, a location of the vaporizer device 100 (e.g., threshold distance away from restriction zones), and/or the like. Upon successfully verifying the age of the user, the computing device 820 may activate the vaporizer device 100 by sending, to the vaporizer device 100, one or more signals configured to activate the vaporizer device 100. For example, the controller 104 at the vaporizer device 100 may respond to the communication hardware 105 receiving the one or more signals by at least activating the power source 112 and/or a heating element (e.g., included in the atomizer 141).

In some implementations of the current subject matter, the computing device 820 may send one or more audio (or optical) signals to activate the vaporizer device 100. For example, as shown in FIG. 7, the user may couple the apparatus 200 with an external power source including by mating the second interface 205*b* with a corresponding interface at the external power source. Moreover, the user may couple the vaporizer device 100 with the apparatus 200 including by mating the vaporizer device 100 with the first interface 205*a*. As noted, the external power source may be the computing device 820. Accordingly, in some instances, the apparatus 200 may be coupled with the vaporizer device 100 as well as the computing device 820.

Once the vaporizer device 100 is coupled with the apparatus 200, the apparatus 200 may output a first audio signal that includes, for example, an identifier of the vaporizer device 100, an identifier of the apparatus 200, and a session identifier. In response to the computing device 820 detecting the first audio signal, the web application at the computing device 820 may cause the computing device 820 to output a second audio signal that includes an identifier of the apparatus 200, a message authentication code (e.g., a hash-based message authentication code (HMAC)), and a response. The second audio signal may encode a second data configured to trigger the activation of the vaporizer device 100. For example, the apparatus 200 may respond to receiving the second packet by at least activating the power source 112 and/or a heating element (e.g., included in the atomizer 141) of the vaporizer device 100.

Terminology

When a feature or element is herein referred to as being "on" another feature or element, it can be directly on the other feature or element or intervening features and/or elements can also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements can be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature can have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device can be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers can be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value can have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes can be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system can include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on," herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and subcombinations of the disclosed features and/or combinations and subcombinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A method, comprising:

detecting, at a computing device, a first audio signal corresponding to a first data associated with a vaporizer device; and in response to detecting the first audio signal, outputting, by the computing device, a second audio signal encoding a second data, wherein the second data indicates an activation control of the vaporizer device, and wherein the vaporizer device is activated by an apparatus coupled with the vaporizer device upon receiving the second audio signal to at least enable the vaporizer device to vaporize a vaporizable material.

2. The method of claim 1, wherein the first audio signal is output by the apparatus.

3. The method of claim 2, wherein the apparatus includes a speaker configured to output the first audio signal.

4. The method of claim 2, wherein the apparatus includes a microphone configured to detect the second audio signal, and wherein the apparatus responds to detecting the second audio signal by at least activating a power source and/or a heating element of the vaporizer device.

5. The method of claim 2, wherein the first data includes a first identifier associated with the vaporizer device, a second identifier associated with the apparatus, and/or a session identifier.

6. The method of claim 2, wherein the second data includes an identifier of the apparatus, a message authentication code, and a response.

7. The method of claim 2, wherein the apparatus outputs the first audio signal in response to the vaporizer device being coupled with the apparatus.

8. The method of claim 2, wherein the apparatus is configured to generate the first audio signal by at least applying a spread spectrum frequency shift keying and/or a forward error correction to encode the first data as one or more frequencies in a human audible spectrum and/or a non-human audible spectrum.

9. The method of claim 2, wherein the apparatus is configured to generate the first audio signal by at least encrypting the first data.

10. The method of claim 9, wherein the encrypting of the first data includes the apparatus and the computing device performing a secure key exchange to establish one or more keys for encrypting the first data.

11. The method of claim 2, wherein the apparatus comprises a dock or a cartridge configured to couple with the vaporizer device.

12. The method of claim 11, wherein the apparatus is configured to couple to an external power source that charges the vaporizer device when the vaporizer device is coupled to the dock.

13. The method of claim 1, wherein prior to outputting the second audio signal, receiving at the computing device one or more signals corresponding to one or more verifications based on a user interaction with the computing device.

14. The method of claim 13, wherein the one or more verifications comprise age verification, cartridge authentication, vaporizer device location, or any combination thereof.

15. The method of claim 13, wherein the one or more signals are received from a web application.

16. The method of claim 13, wherein the computing device receives activation data configured to activate the vaporizer device based at least on the one or more verifications.

* * * * *